US010845021B2

(12) United States Patent
Ohno

(10) Patent No.: US 10,845,021 B2
(45) Date of Patent: Nov. 24, 2020

(54) LAMP UNIT

(71) Applicant: Koito Manufacturing Co., Ltd, Tokyo (JP)

(72) Inventor: Tomoyuki Ohno, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 15/984,177

(22) Filed: May 18, 2018

(65) Prior Publication Data

US 2018/0266642 A1 Sep. 20, 2018

Related U.S. Application Data

(63) Continuation of application No. PCT/JP2016/083558, filed on Nov. 11, 2016.

(30) Foreign Application Priority Data

Nov. 20, 2015 (JP) ..... 2015-228037
Nov. 20, 2015 (JP) ..... 2015-228038

(51) Int. Cl.
*F21S 41/29* (2018.01)
*F21S 41/32* (2018.01)
(Continued)

(52) U.S. Cl.
CPC ..... *F21S 41/295* (2018.01); *F21S 41/143* (2018.01); *F21S 41/151* (2018.01); *F21S 41/153* (2018.01);
(Continued)

(58) Field of Classification Search
CPC ..... F21S 41/151; F21S 41/153; F21S 41/36
See application file for complete search history.

(56) References Cited

U.S. PATENT DOCUMENTS 9,332,205 B2 5/2016 Fukuda
2009/0034278 A1 2/2009 Tessnow et al.
(Continued)

FOREIGN PATENT DOCUMENTS

CN 101132950 A 2/2008
CN 103090286 A 5/2013
(Continued)

OTHER PUBLICATIONS

Machine translation of "Terada et al.", JP 2011070877A, published Apr. 7, 2011 (Year: 2011).*
(Continued)

*Primary Examiner* — William N Harris
(74) *Attorney, Agent, or Firm* — Buchanan Ingersoll & Rooney PC

(57) ABSTRACT

A light emitting module includes an upper light emitting unit, a lower light emitting unit, an intermediate reflector provided between the upper light emitting unit and the lower light emitting unit, and a lens that projects images of the upper light emitting unit and the lower light emitting unit to a space in front of a vehicle. A plurality of semiconductor light emitting devices are provided such that a light emitting surface of each light emitting device faces the lens, and the intermediate reflector includes a reflecting surface that reflects a portion of light emitted from at least one of the upper light emitting unit and the lower light emitting unit toward the lens.

4 Claims, 25 Drawing Sheets

(51) Int. Cl.

| | |
|---|---|
| ***F21S 41/151*** | (2018.01) |
| ***F21S 41/143*** | (2018.01) |
| ***F21S 41/153*** | (2018.01) |
| ***F21S 41/36*** | (2018.01) |
| ***F21Y 105/12*** | (2016.01) |
| ***F21Y 115/10*** | (2016.01) |
| ***F21S 41/20*** | (2018.01) |
| ***F21S 41/24*** | (2018.01) |
| ***F21S 41/40*** | (2018.01) |
| *F21S 41/39* | (2018.01) |
| *F21S 45/43* | (2018.01) |

(52) U.S. Cl.

CPC ..... *F21S 41/24* (2018.01); *F21S 41/285* (2018.01); *F21S 41/323* (2018.01); *F21S 41/36* (2018.01); *F21S 41/40* (2018.01); *F21S 41/39* (2018.01); *F21S 45/43* (2018.01); *F21Y 2105/12* (2016.08); *F21Y 2115/10* (2016.08)

(56) References Cited

U.S. PATENT DOCUMENTS

| | | | | |
|---|---|---|---|---|
| 2009/0168401 | A1* | 7/2009 | Kwon | G02F 1/133603 362/97.1 |
| 2012/0139445 | A1* | 6/2012 | Fujiwara | G02F 1/133603 315/294 |
| 2014/0016340 | A1* | 1/2014 | Cho | F21S 41/141 362/516 |
| 2014/0043843 | A1* | 2/2014 | Moser | F21S 41/141 362/545 |
| 2014/0307458 | A1* | 10/2014 | Brendle | F21S 41/143 362/516 |
| 2015/0085523 | A1* | 3/2015 | Gurtl | F21S 41/143 362/607 |
| 2015/0146448 | A1* | 5/2015 | Han | F21S 41/143 362/522 |
| 2018/0245759 | A1* | 8/2018 | Plank | F21S 41/143 |
| 2019/0360652 | A1* | 11/2019 | Ishida | F21S 41/40 |

FOREIGN PATENT DOCUMENTS

| | | | |
|---|---|---|---|
| CN | 103392093 | A | 11/2013 |
| CN | 103542380 | A | 1/2014 |
| CN | 103883958 | A | 6/2014 |
| CN | 104105921 | A | 10/2014 |
| CN | 104421714 | A | 3/2015 |
| DE | 102009020619 | A1 | 11/2010 |
| EP | 2143994 | A1 | 7/2009 |
| EP | 2587125 | A2 | 5/2013 |
| EP | 2591952 | A2 | 5/2013 |
| EP | 2846081 | A1 | 3/2015 |
| JP | S61251180 | A | 11/1986 |
| JP | H04-98701 | A | 3/1992 |
| JP | 2009087681 | A | 4/2009 |
| JP | 2009176488 | A | 8/2009 |
| JP | 2011070877 | A | 4/2011 |
| JP | 2012109145 | A | 6/2012 |
| JP | 2013168434 | A | 8/2013 |
| JP | 2015510674 | A | 4/2015 |
| JP | 2015149307 | A | 8/2015 |
| JP | 2015185533 | A | 10/2015 |

OTHER PUBLICATIONS

International Search Report for the corresponding PCT Application No. PCT/JP2016/083558, with an English translation, dated Jan. 17, 2017.

International Preliminary Examination Report on Patentability with Written Opinion of ISA for the corresponding PCT Application No. PCT/JP2016/083558, with an English translation, dated May 22, 2018.

Extended European Search Report dated Jul. 3, 2019 in corresponding European Patent Application No. 16866253.4.

First Office Action dated Dec. 24, 2019 in corresponding Chinese Patent Application No. 201680067480.0 with English Translation, 22 pages.

Office Action (Notification of Reasons for Refusal) dated May 12, 2020, by the Japanese Patent Office in corresponding Japanese Patent Application No. 2017-551854 and English translation of the Office Action. (7 pages).

Notification of The Second Office Action issued by the National Intellectual Property Administration of the People's Republic of China in corresponding Chinese Patent Application No. 201680067480.0 dated Sep. 22, 2020 (23 pages including partial English translation).

* cited by examiner

10

LAMP UNIT

CROSS-REFERENCE TO RELATED APPLICATIONS

This application is based upon and claims the benefit of priority from the prior Japanese Patent Application No. 2015-228037, filed on Nov. 20, 2015, Japanese Patent Application No. 2015-228038, filed on Nov. 20, 2015 and International Patent Application No. PCT/JP2016/083558, filed on Nov. 11, 2016, the entire content of each of which is incorporated herein by reference.

BACKGROUND OF THE INVENTION

1. Field of the Invention

The present invention relates to a lamp unit.

2. Description of the Related Art

A lamp of a projector type having a projection lens, a light source unit provided with an LED array including an array of a plurality of LEDs, and a holder configured to hold the projection lens and the light source unit is proposed (see JP2012-109145).

In the LED array described above, the LEDs are in close proximity to each other in the vertical and horizontal directions so that an area between adjacent LEDs not emitting light is not likely to show itself as a dark section in the light distribution pattern.

However, since the LEDs are in close proximity to each other, the related-art array is disadvantageous in terms of heat dissipation. In addition, a larger number of LEDs will be necessary for formation of a light distribution pattern having a desired extent. As a result, the cost will be increased. By increasing the gap between vertically adjacent LEDs in an LED array of a plurality of rows, heat dissipation is improved and a light distribution pattern capable of illuminating a larger area can be formed without increasing the number of LEDs. Meanwhile, by increasing the gap between vertically adjacent LEDs, an area between vertically adjacent LEDs not emitting light is likely to show itself as a dark section in the light distribution pattern.

SUMMARY OF THE INVENTION

In this background, a purpose of the present invention is to provide a novel technology of reducing the occurrence of dark sections caused by gaps between light emitting devices.

Another purpose is to provide a novel technology that makes dark sections caused by gaps between light emitting devices less noticeable in a projected image.

A lamp unit according to an embodiment of the present invention comprises: a light emitting unit in a first row in which a plurality of light emitting devices are arranged horizontally; a light emitting unit in a second row in which a plurality of light emitting devices are arranged horizontally; a first reflector provided between the light emitting unit in the first row and the light emitting unit in the second row; and a lens that projects images of the light emitting unit in the first row and the light emitting unit in the second row to a space in front of a vehicle. The plurality of light emitting devices are provided such that a light emitting surface of each light emitting device faces the lens, and the first reflector includes a reflecting surface that reflects a portion of light emitted from at least one of the light emitting unit in the first row and the light emitting unit in the second row toward the lens. The light emitting unit in the first row and the light emitting unit in the second row are configured such that a gap G1 between the light emitting unit in the first row and the light emitting unit in the second row is larger than a minimum gap G2 between horizontally adjacent light emitting devices in the light emitting unit in the first row or the light emitting unit in the second row.

A lamp unit according to another embodiment of the present invention comprises: a light source including a light emitting unit in a first row in which a plurality of light emitting devices are arranged horizontally and a light emitting unit in a second row in which a plurality of light emitting devices are arranged horizontally; a lens that projects images of the light emitting unit in the first row and the light emitting unit in the second row to a space in front of a vehicle; and an optical member provided between the light source and the lens. The light source is provided such that a light emitting surface of the light source faces an incidence surface of the lens, and the optical member is configured to change a light path of at least a portion of incident light.

BRIEF DESCRIPTION OF THE DRAWINGS

Embodiments will now be described, by way of example only, with reference to the accompanying drawings that are meant to be exemplary, not limiting, and wherein like elements are numbered alike in several figures, in which.

DETAILED DESCRIPTION OF THE INVENTION

Figure 1:
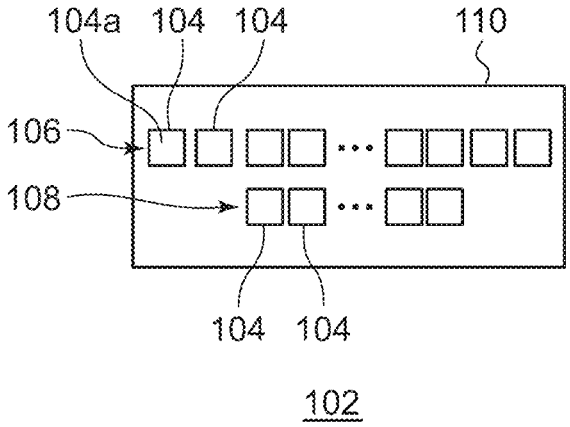
FIG. 1 is a front view of a light emitting module used in a lamp unit according to reference example 1.

A lamp unit according to an embodiment of the present invention comprises: a light emitting unit in a first row in which a plurality of light emitting devices are arranged horizontally; a light emitting unit in a second row in which a plurality of light emitting devices are arranged horizontally; a first reflector provided between the light emitting unit in the first row and the light emitting unit in the second row; and a lens that projects images of the light emitting unit in the first row and the light emitting unit in the second row to a space in front of a vehicle. The plurality of light emitting devices are provided such that a light emitting surface of each light emitting device faces the lens, and the first reflector includes a reflecting surface that reflects a portion of light emitted from at least one of the light emitting unit in the first row and the light emitting unit in the second row toward the lens. The light emitting unit in the first row and the light emitting unit in the second row are configured such that a gap G1 between the light emitting unit in the first row and the light emitting unit in the second row is larger than a minimum gap G2 between horizontally adjacent light emitting devices in the light emitting unit in the first row or the light emitting unit in the second row.

According to this embodiment, the reflecting surface provided in the first reflector provided between the light emitting unit in the first row and the light emitting unit in the second row ensure that a portion of the light emitted from at least one of the light emitting unit in the first row and the light emitting unit in the second row is reflected toward the lens. Therefore, even if the gap G1 between the light emitting unit in the first row and the light emitting unit in the second row is large, the light appears to be emitted from an area not emitting light and corresponding to the gap G1. Therefore, the area not emitting light is inhibited from directly showing itself as a dark section in a portion of the light distribution pattern.

The number N1 of light emitting devices in the light emitting unit in the first row may be larger than the number N2 of light emitting devices in the light emitting unit in the second row, and the light emitting unit in the first row may be provided above the light emitting unit in the second row. This ensures that, when the lamp unit is used as a vehicle headlamp, the lens causes the elongated image of the light emitting unit in the first row located above the light emitting unit in the second row to form the lower part of the light distribution pattern.

In the light emitting unit in the first row, a gap G4 between adjacent light emitting devices at horizontal ends is larger than a gap G3 between adjacent light emitting devices in the center. In this way, a high-brightness area is formed in the center of the light distribution pattern, and, at the same time, the number of light emitting devices required to form a light distribution pattern of a desired extent can be reduced.

The lamp unit may further comprise a second reflector provided in an area adjacent to the light emitting unit in the second row opposite to a side adjacent to the light emitting unit in the first row. The second reflector may include a reflecting surface that reflects a portion of light emitted from the light emitting unit in the second row toward the lens. The first reflector may be located at a position that blocks a light path of light emitted from the light emitting unit in the first row and traveling toward the reflecting surface of the second reflector. This inhibits the light emitted from the light emitting unit in the first row from being reflected by the second reflector and traveling toward the lens while the light emitting unit in the second row is turned off, thereby preventing drivers, pedestrians, etc. located in an area that should be not illuminated from experiencing glare.

A lamp unit according to another embodiment of the present invention comprises: a light source including a light emitting unit in a first row in which a plurality of light emitting devices are arranged horizontally and a light emitting unit in a second row in which a plurality of light emitting devices are arranged horizontally; a lens that projects images of the light emitting unit in the first row and the light emitting unit in the second row to a space in front of a vehicle; and an optical member provided between the light source and the lens. The light source is provided such that a light emitting surface of the light source faces an incidence surface of the lens, and the optical member is configured to change a light path of at least a portion of incident light.

According to this embodiment, the optical member provided between the light source and the lens makes the dark sections caused by the gaps between the light emitting devices less noticeable in the projected images when images of the light emitting unit in the first row and the light emitting unit in the second row are projected to a space in front of the vehicle.

The optical member may be a diffuser. Accordingly, the dark sections caused by the gaps between the light emitting devices can be blurred in the projected images.

The diffuser may be provided between an area between the light emitting unit in the first row and the light emitting unit in the second row not emitting light, and the lens. This can selectively blur the dark sections caused by the gaps between the light emitting devices in the projected images. In other words, those parts of the projected images directly representing the light emitting areas are not blurred so much.

The diffuser may include a high diffusivity part having a high diffuse transmittance and a low diffusivity part having a low diffuse transmittance. This can form bright sections and dark sections at desired positions in projected images.

The optical member may be a light guide in which light is refracted on an incidence surface on which light emitted from the light source is incident or on an exit surface on which transmitted light exits. This makes the dark sections caused by the gaps between the light emitting devices less noticeable in the projected images.

Optional combinations of the aforementioned constituting elements, and implementations of the invention in the form of methods, apparatuses, systems, components, and control methods may also be practiced as additional modes of the present invention.

According to the embodiment, occurrence of dark sections caused by gaps between light emitting devices is inhibited.

A description will be given of the embodiments of the present invention with reference to the drawings. In the explanations of the figures, the same elements shall be denoted by the same reference numerals, and duplicative explanations will be omitted appropriately. The structure described below is by way of example only and does not limit the scope of the present invention.

Reference Example 1

Figure 2:
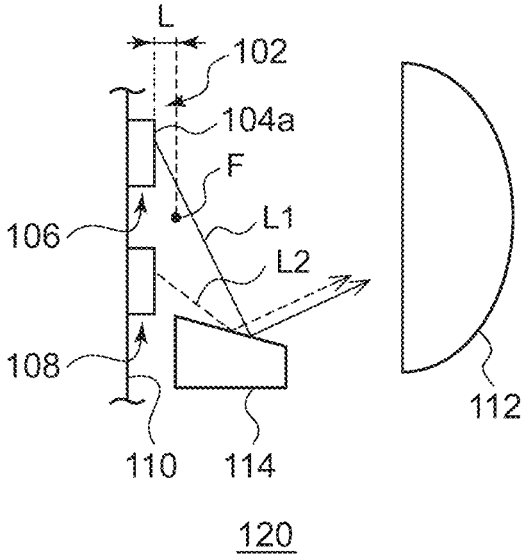
FIG. 2 is a side view of the lamp unit according to reference example 1.

A description will first be given of a problem of an optical system using an LED array as a light source in which a reflector is provided around the LED array. FIG. 1 is a front view of a light emitting module used in a lamp unit according to reference example 1. FIG. 2 is a side view of the lamp unit according to reference example 1.

As shown in FIG. 1, a light emitting module 102 includes, in a front view, an upper light emitting unit 106 in which a plurality of semiconductor light emitting devices 104 are arranged horizontally in a row such that a light emitting surface 104*a* faces the frontal direction, and a lower light emitting unit 108 in which a plurality of semiconductor light emitting devices 104 are arranged horizontally in a row such that a light emitting surface 104*a* faces the frontal direction. The upper light emitting unit 106 is provided toward the top of a substrate 110, and the lower light emitting unit 108 is provided more toward the bottom of the substrate 110 than the upper light emitting unit 106.

As shown in FIG. 2, the lamp unit 120 includes the light emitting module 102, a projection lens 112 configured to project images of the upper light emitting unit 106 and the lower light emitting unit 108 to a space in front of a vehicle, and a lower reflector 114 in an area adjacent to the lower light emitting unit 108 opposite to the side adjacent to the upper light emitting unit 106. The focal point F of the projection lens 112 is on the light axis of the lamp unit 120 and is displaced toward the projection lens 112 by about 1 mm from a plane including the light emitting surface 104*a* of the semiconductor light emitting device 104.

Figure 3A:
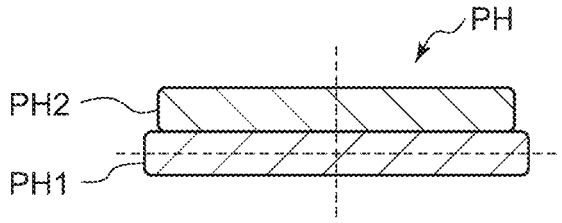
FIG. 3A shows a light distribution pattern produced when the upper light emitting unit and the lower light emitting unit are turned on in the lamp unit.
Figure 3B:
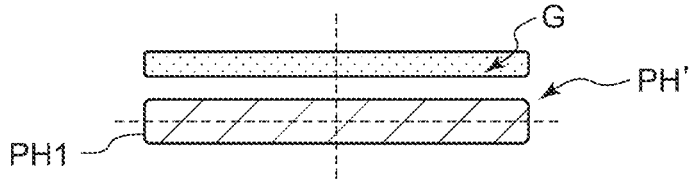
FIG. 3B shows a light distribution pattern produced when the upper light emitting unit is turned on and the lower light emitting unit is turned off in the lamp unit.

FIG. 3A shows a light distribution pattern produced when the upper light emitting unit 106 and the lower light emitting unit 108 are turned on in the lamp unit 120, and FIG. 3B shows a light distribution pattern produced when the upper light emitting unit 106 is turned on and the lower light emitting unit 108 is turned off in the lamp unit 120.

The light distribution pattern PH shown in FIG. 3A includes a light distribution pattern PH1 and a light distribution pattern PH2 overlapping each other, the light distribution pattern PH1 being a lower area of the light distribution pattern PH illuminated by the upper light emitting unit 106, and the light distribution pattern PH2 being an upper area of the light distribution pattern PH illuminated by the lower light emitting unit 108.

In contrast, the light distribution pattern PH' shown in FIG. 3B has the light distribution pattern PH1 in the lower area of the light distribution pattern PH illuminated by the upper light emitting unit 106 but the upper area above the light distribution pattern PH' should not be illuminated since the lower light emitting unit 108 is turned off.

However, the lamp unit 120 is provided with the lower reflector 114 as shown in FIG. 2. For this reason, the light L1 emitted from the upper light emitting unit 106, reflected by the lower reflector 114 and entering the projection lens 112 appears similar to the light L2 emitted by the lower light emitting unit 108, reflected by the lower reflector 114, and entering the projection lens 112.

In other words, the lower light emitting unit 108 appears as if it is turned on despite the fact that the lower light emitting unit 108 is turned off. Therefore, glare G is produced in an area above the light distribution pattern PH' that would have been illuminated if the lower light emitting unit 108 is turned on (see FIG. 3B). We have arrived at a solution to reduce the occurrence of glare G like this by positioning reflectors inventively. A description will now be given of the feature of each embodiment.

First Embodiment

Figure 4:
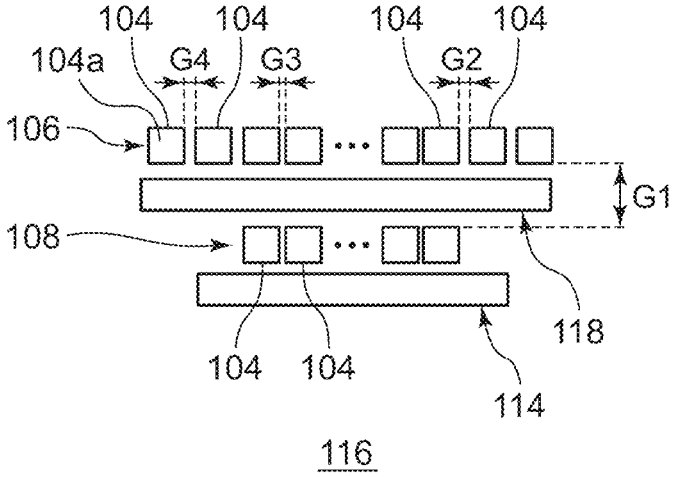
FIG. 4 is a front view of a light emitting module used in a lamp unit according to the first embodiment.
Figure 5:
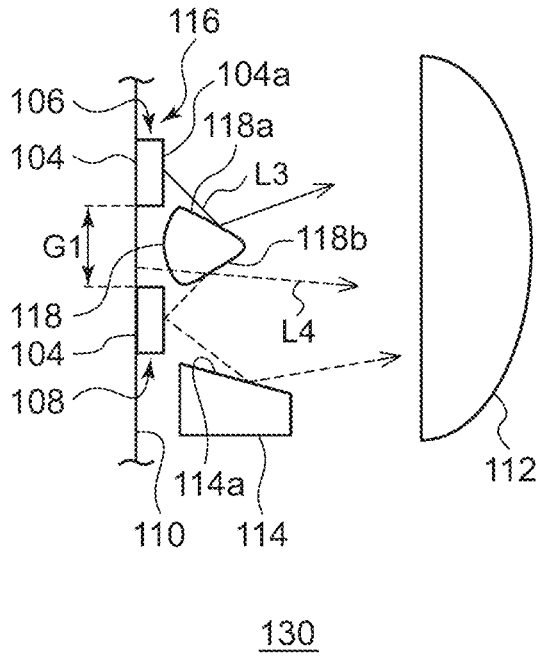
FIG. 5 is a side view of the lamp unit according to the first embodiment.

FIG. 4 is a front view of a light emitting module used in a lamp unit according to the first embodiment. FIG. 5 is a side view of the lamp unit according to the first embodiment. Those components that are equivalent to the components of the lamp unit 120 according to reference example 1 are denoted with the same reference numerals and a description thereof is omitted as appropriate.

As shown in FIG. 4, a light emitting module 116 includes, in a front view, an upper light emitting unit 106 and a lower light emitting unit 108. The upper light emitting unit 106 is provided toward the top of a substrate 110 (not shown in FIG. 4), and the lower light emitting unit 108 is provided more toward the bottom of the substrate 110 than the upper light emitting unit 106.

As shown in FIG. 5, the lamp unit 130 is provided with the light emitting module 116, an intermediate reflector 118 provided between the upper light emitting unit 106 and the lower light emitting unit 108 of the light emitting module 116, the lower reflector 114, and the projection lens 112. The plurality of semiconductor light emitting devices 104 are provided such that the light emitting surface 104*a* of a light emitting device faces the projection lens 112. The intermediate reflector 118 has reflecting surfaces 118*a* and 118*b* configured to reflect a portion of the light emitted from at least one of the upper light emitting unit 106 and the lower light emitting unit 108 toward the projection lens 112.

The upper light emitting unit 106 and the lower light emitting unit 108 are configured such that a gap G1 between the upper light emitting unit 106 and the lower light emitting unit 108 is larger than the minimum gap G2 between horizontally adjacent semiconductor light emitting devices 104 in the upper light emitting unit 106 or the lower light emitting unit 108.

Figure 6A:
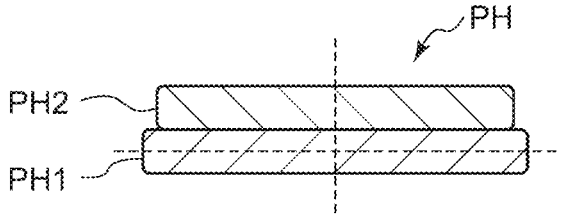
FIG. 6A shows a light distribution pattern produced when the upper light emitting unit and the lower light emitting unit are turned on in the lamp unit.
Figure 6B:
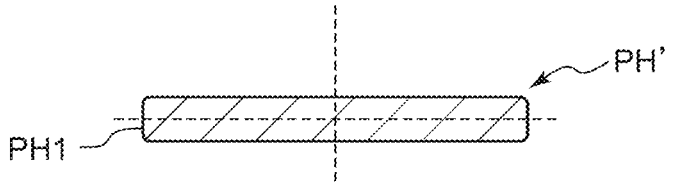
FIG. 6B shows a light distribution pattern produced when the upper light emitting unit is turned on and the lower light emitting unit is turned off in the lamp unit.
Figure 7A:
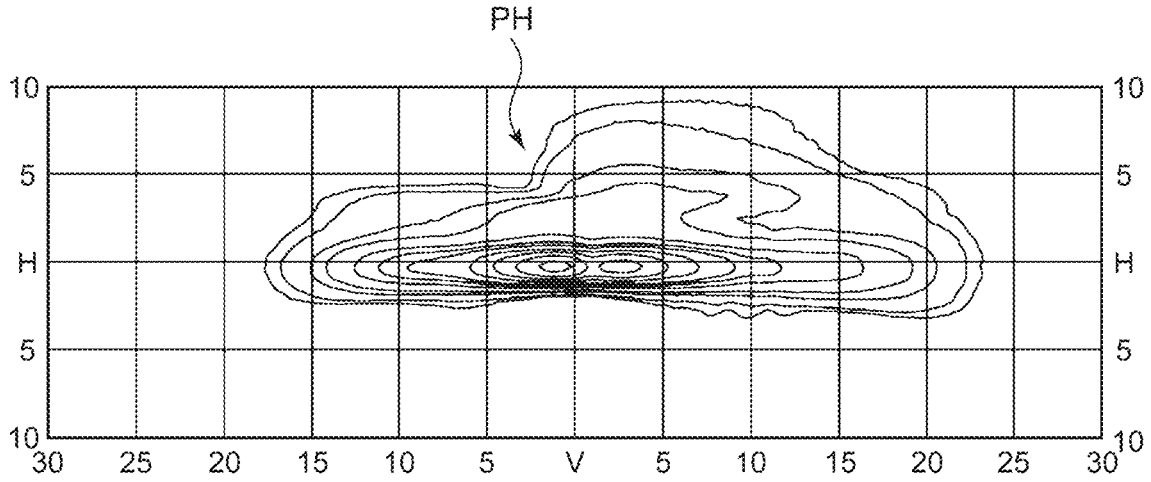
FIG. 7A is a chart showing a simulation of the illuminance distribution of the light distribution pattern PH shown in FIG. 6A.
Figure 7B:
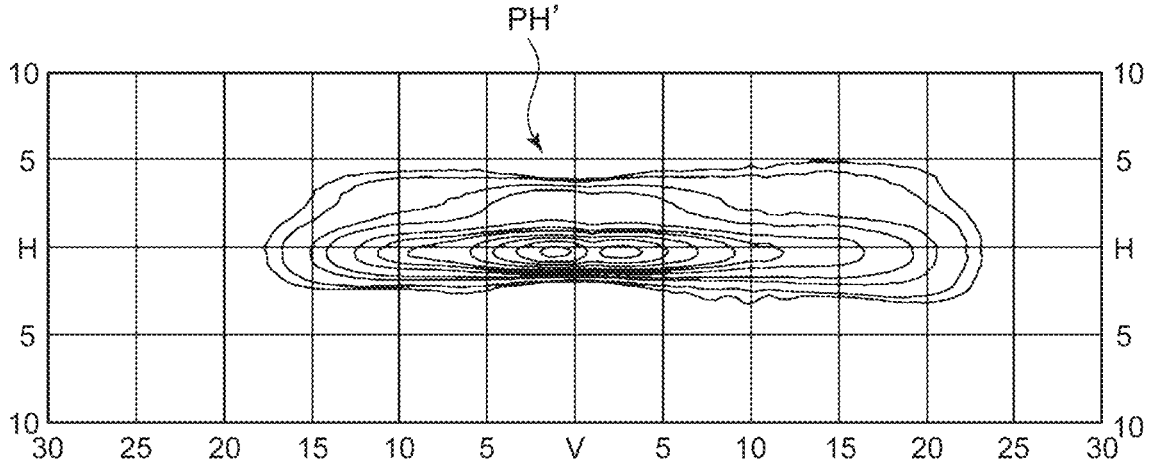
FIG. 7B is a chart showing a simulation of the illuminance distribution of the light distribution pattern PH' shown in FIG. 6B.

FIG. 6A shows a light distribution pattern produced when the upper light emitting unit 106 and the lower light emitting unit 108 are turned on in the lamp unit 130, and FIG. 6B shows a light distribution pattern produced when the upper light emitting unit 106 is turned on and the lower light emitting unit 108 is turned off in the lamp unit 130. FIG. 7A is a chart showing a simulation of the illuminance distribution of the light distribution pattern PH shown in FIG. 6A, and FIG. 7B is a chart showing a simulation of the illuminance distribution of the light distribution pattern PH' shown in FIG. 6B.

The light distribution pattern PH shown in FIG. 6A includes a light distribution pattern PH1 and a light distribution pattern PH2 overlapping each other, the light distribution pattern PH1 being a lower area of the light distribution pattern PH illuminated by the upper light emitting unit 106, and the light distribution pattern PH2 being an upper area of the light distribution pattern PH illuminated by the lower light emitting unit 108.

In contrast, the light distribution pattern PH' shown in FIG. 6B has the light distribution pattern PH1 in the lower area of the light distribution pattern PH illuminated by the upper light emitting unit 106. Further, since the lower light emitting unit 108 is turned off, the upper area of the light distribution pattern PH' is not illuminated and glare G as shown in FIG. 3B is not produced.

Since the lamp unit 120 is provided with the intermediate reflector 118 as shown in FIG. 5, the light L3 emitted from the upper light emitting unit 106 and traveling in a direction where the lower reflector 114 is located is reflected by the reflecting surface 118*a* of the intermediate reflector 118 and enters the projection lens 112. The lower reflector 114 has a reflecting surface 114*a* configured to reflect a portion of the light emitted from the lower light emitting unit 108 toward the projection lens 112.

The intermediate reflector 118 is located at a position that blocks the light path of the light emitted from the upper light emitting unit 106 and traveling toward the reflecting surface 114*a* of the lower reflector 114. This inhibits the light emitted from the upper light emitting unit 106 from being reflected by the lower reflector 114 and traveling toward the projection lens 112 while the lower light emitting unit 108 is turned off, thereby preventing drivers, pedestrians, etc. located in an area that should be not illuminated from experiencing glare.

In the lamp unit 130 according to this embodiment, the reflecting surfaces 118*a* and 118*b* provided in the intermediate reflector 118 provided between the upper light emitting unit 106 and the lower light emitting unit 108 ensure that a portion of the light emitted from at least one of the upper light emitting unit 106 and the lower light emitting unit 108 is reflected toward the projection lens 112. Therefore, even if the gap G1 between the upper light emitting unit 106 and the lower light emitting unit 108 is large, the light appears to be emitted from an area not emitting light and corresponding to the gap G1 (see the light L4 in FIG. 5). Therefore, the area not emitting light is inhibited from directly showing itself as a dark section in a portion of the light distribution pattern PH.

In this embodiment, the number N1 of semiconductor light emitting devices 104 in the upper light emitting unit 106 is larger than the number N2 of semiconductor light emitting devices 104 in the lower light emitting unit 108. When the lamp unit 130 is used as a vehicle headlamp, the elongated image of the upper light emitting unit 106 located above the light emitting part of the lower light emitting unit 108 is inverted by the projection lens 112 and forms the lower part of the light distribution pattern PH.

In the upper light emitting unit 106, the gap G4 between adjacent semiconductor light emitting devices 104 at the horizontal ends is larger than the gap G3 between adjacent semiconductor light emitting devices 104 in the center. In this way, a high-brightness area is formed in the center of the light distribution pattern shown in shown in FIGS. 7A and 7B, and, at the same time, the number of semiconductor light emitting devices 104 required to form a light distribution pattern of a desired extent can be reduced.

Second Embodiment

Figure 8:
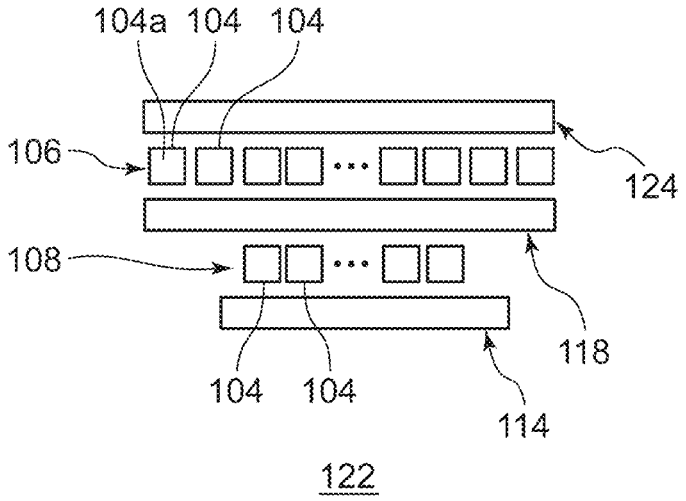
FIG. 8 is a front view of a light emitting module used in a lamp unit according to the second embodiment.
Figure 9:
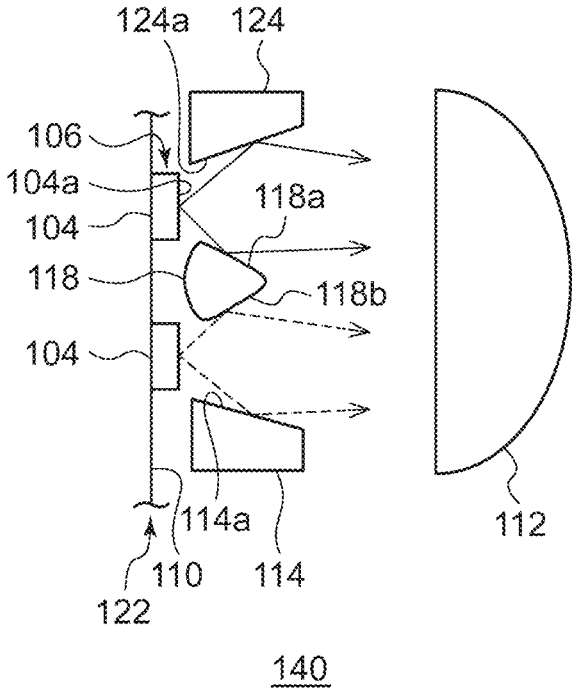
FIG. 9 is a side view of the lamp unit according to the second embodiment.

FIG. 8 is a front view of a light emitting module used in a lamp unit according to the second embodiment. FIG. 9 is a side view of the lamp unit according to the second embodiment. Those components that are equivalent to the components of the lamp unit 130 according to the first embodiment are denoted with the same reference numerals and a description thereof is omitted as appropriate.

As shown in the figure, a lamp unit 140 is provided with a light emitting module 122, an intermediate reflector 118 provided between the upper light emitting unit 106 and the lower light emitting unit 108 of the light emitting module 116, the lower reflector 114, an upper reflector 124, and the projection lens 112. The upper reflector 124 is provided in an area adjacent to the upper light emitting unit 106 opposite to the side adjacent to the lower light emitting unit 108. A reflecting surface 124*a* of the upper reflector 124 primary reflects the light emitted from the upper light emitting unit 106 toward the projection lens 112.

Figure 10A:
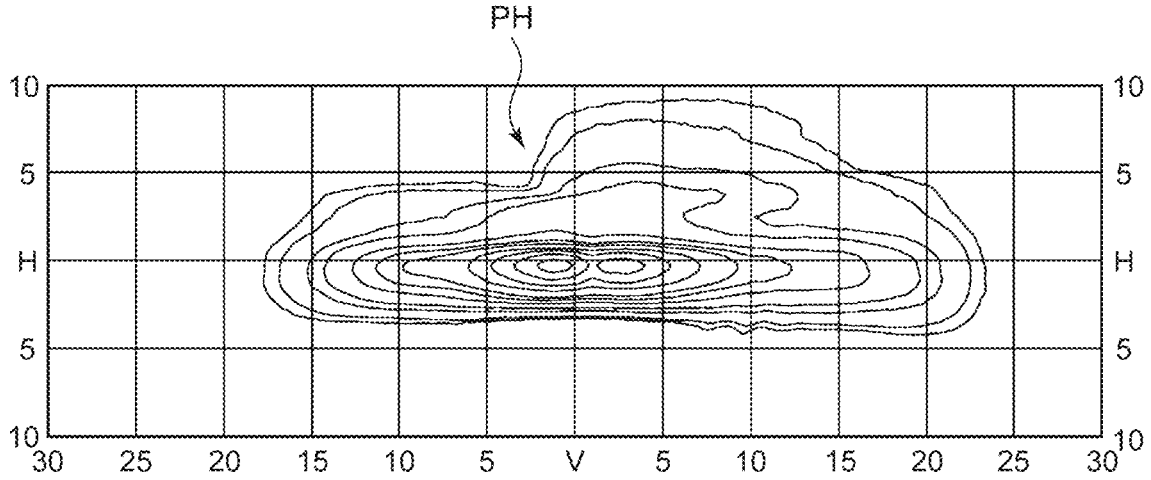
FIG. 10A is a chart showing a simulation of the illuminance distribution of the light distribution pattern PH produced when the upper light emitting unit and the lower light emitting unit are turned on in the lamp unit.
Figure 10B:
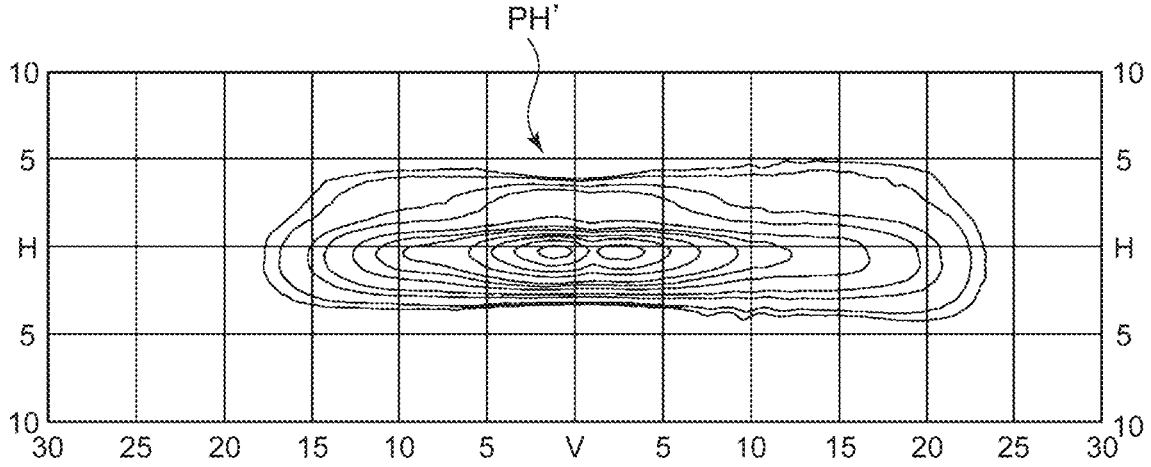
FIG. 10B is a chart showing a simulation of the illuminance distribution of the light distribution pattern PH' produced when the upper light emitting unit is turned on and the lower light emitting unit 108 is turned off in the lamp unit.

FIG. 10A is a chart showing a simulation of the illuminance distribution of the light distribution pattern PH produced when the upper light emitting unit 106 and the lower light emitting unit 108 are turned on in the lamp unit 140, and FIG. 10B is a chart showing a simulation of the illuminance distribution of the light distribution pattern PH' produced when the upper light emitting unit 106 is turned on and the lower light emitting unit 108 is turned off in the lamp unit 140.

The light distribution pattern PH shown in FIG. 10A includes a light distribution pattern PH1 and a light distribution pattern PH2 overlapping each other, the light distribution pattern PH1 being a lower area of the light distribution pattern PH illuminated by the upper light emitting unit 106, and the light distribution pattern PH2 being an upper area of the light distribution pattern PH illuminated by the lower light emitting unit 108.

In contrast, the light distribution pattern PH' shown in FIG. 10B has the light distribution pattern PH1 in the lower area of the light distribution pattern PH illuminated by the upper light emitting unit 106.

Further, since the lower light emitting unit 108 is turned off, the upper area of the light distribution pattern PH' is not illuminated and glare G as shown in FIG. 3B is not produced. This is because, the lamp unit 140 is provided with the intermediate reflector 118 as shown in FIG. 9.

Third Embodiment

In the third embodiment, a description will be given of a vehicle lamp to which the lamp module according to the foregoing embodiments can be applied.

Figure 11:
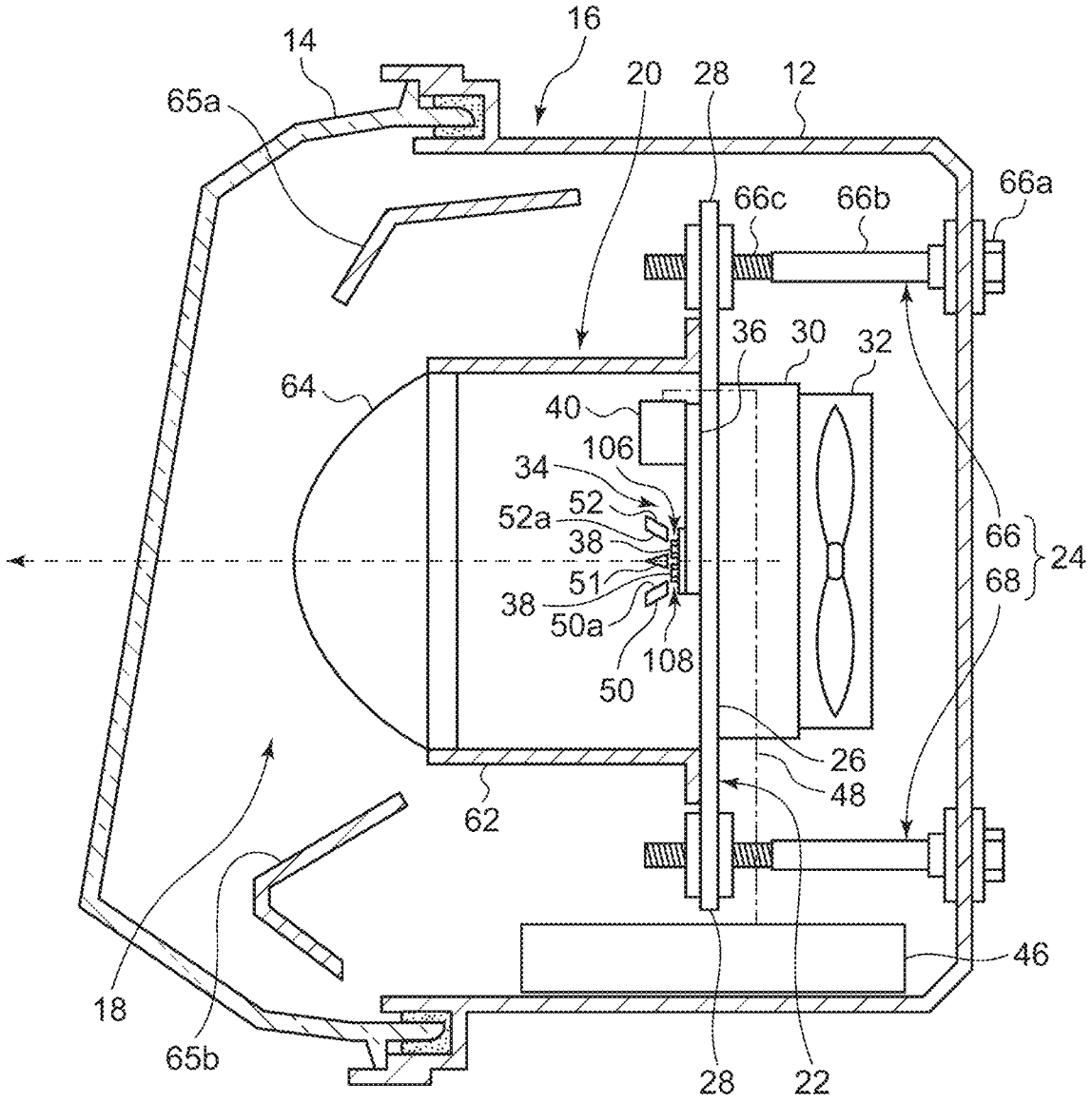
FIG. 11 shows a schematic longitudinal cross section of a vehicle lamp according to the third embodiment.
Figure 12:
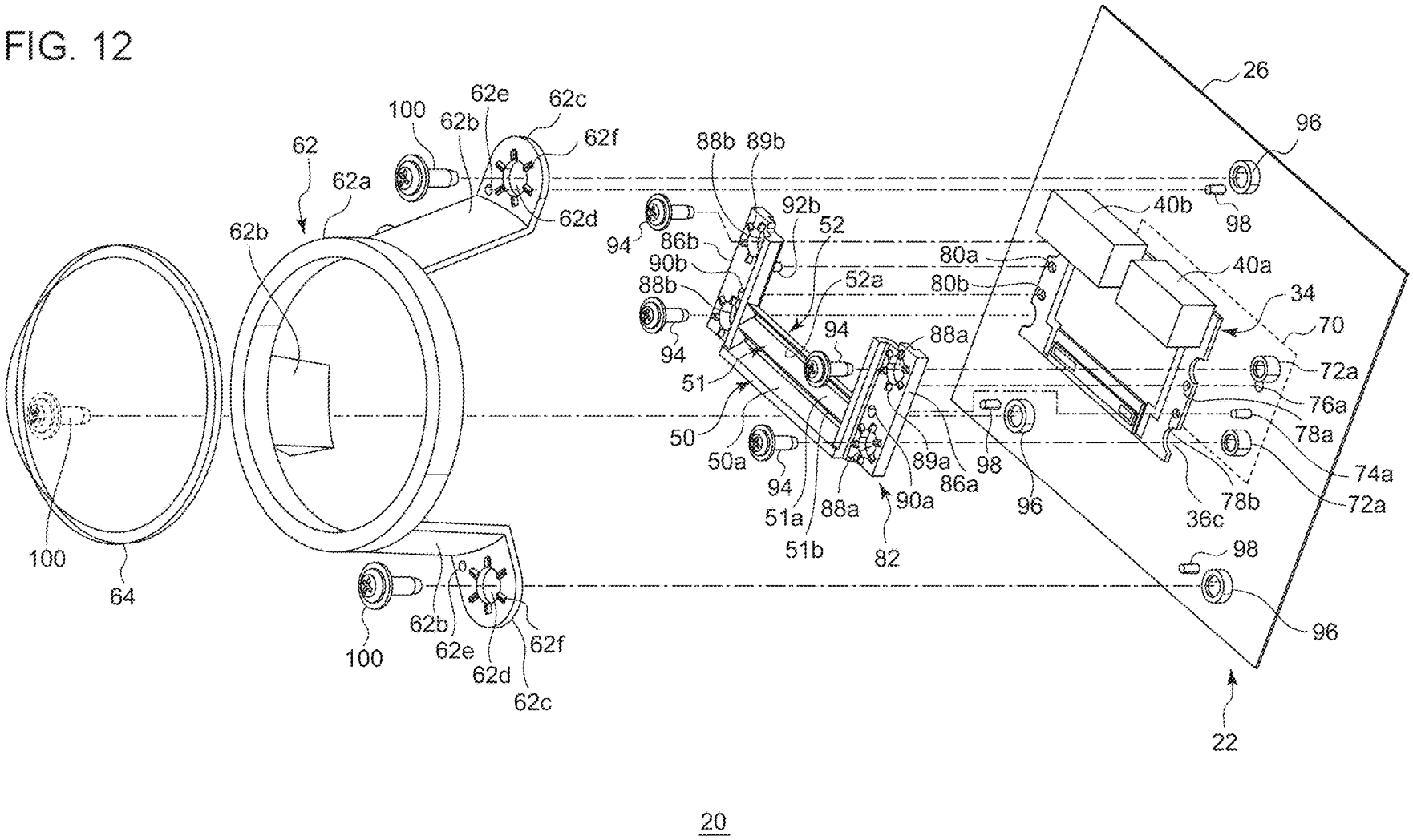
FIG. 12 is an exploded perspective view of a lamp unit shown in FIG. 11.
Figure 13:
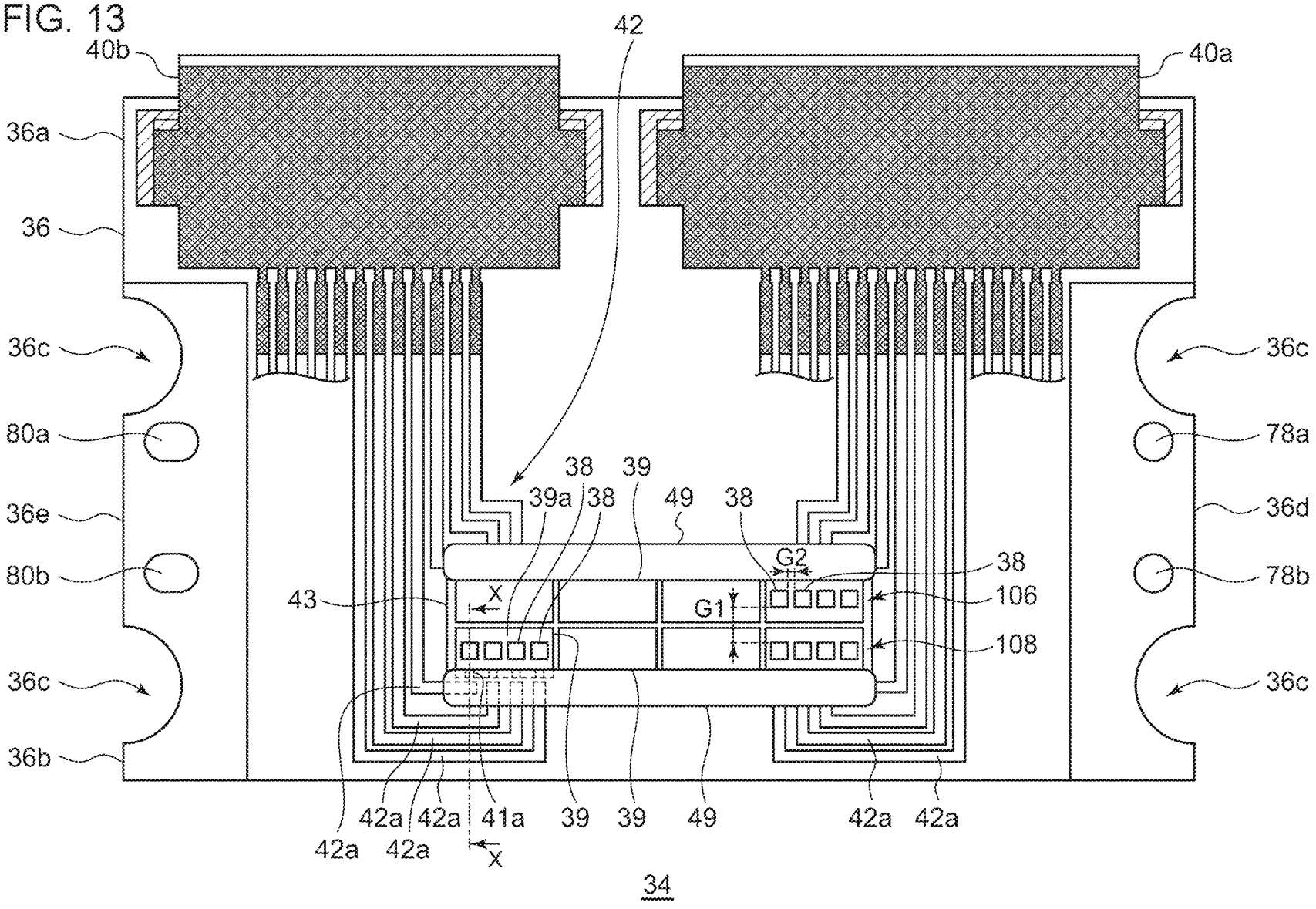
FIG. 13 is a front view of a light emitting module shown in FIG. 11.

FIG. 11 shows a schematic longitudinal cross section of a vehicle lamp according to the third embodiment. FIG. 12 is an exploded perspective view of a lamp unit 20 shown in FIG. 11. FIG. 13 is a front view of a light emitting module 34 shown in FIG. 11. The vehicle lamp 10 shown in FIG. 11 functions as a headlamp used in a vehicle.

The vehicle lamp 10 is provided at the left and right ends of the front of the vehicle. As shown in FIG. 11, the vehicle lamp 10 is provided with a lamp body 12 that opens to a space in front and a front cover 14 fitted to the open front part of the lamp body 12. The lamp body 12 and the front cover 14 form a lamp housing 16. A lamp chamber 18 is formed in the lamp housing 16.

The lamp unit 20 is provided in the lamp chamber 18. The lamp unit 20 is configured to form a light distribution pattern for a high beam. A holder member 22 is also provided in the lamp chamber 18. A light axis adjustment mechanism 24 is configured to move the holder member 22 so as to be inclined in the transversal direction or the longitudinal direction as desired. The holder member 22 is made of a metal material having a high thermal conductivity and has a base part 26 that faces the longitudinal direction. The holder member 22 functions as part of a heat sink.

The base part 26 is provided with supported parts 28, 28, 28 on the upper and lower ends thereof (in FIG. 11, only two supported parts 28, 28 are shown). A heat dissipating fin 30 is provided on the back surface of the base part 26 to project backward. A heat dissipating fan 32 is attached to the back surface of the heat dissipating fin 30.

The light emitting module 34 is attached to an area from the center to the top on the font face of the base part 26.

As shown in FIG. 13, the light emitting module 34 has a circuit substrate 36, a plurality of semiconductor light emitting devices 38, and two power feeding connectors 40*a* and 40*b*.

As shown in FIG. 13, the circuit substrate 36 made of copper is comprised of an upper part 36*a* and a lower part 36*b*. The left and right ends of the circuit substrate 36 are each formed with two notches 36*c* between the upper part 36*a* and the lower part 36*b*.

In the circuit substrate 36, the power feeding connectors 40*a* and 40*b* are provided in the upper part 36*a* and the plurality of semiconductor light emitting devices 38 are provided in the lower part 36*b*.

The semiconductor light emitting devices 38 function as sheet light sources that emit light and are arranged transversally such that the light emitting surfaces face a space in front of the vehicle. LEDs, laser diode (LD) devices, electroluminescence (EL) devices, or the like are suitably used as the semiconductor light emitting devices 38. In this embodiment, eight LED packages 39 each including four LED chips placed in a row are arranged in two rows, resulting in an LED array of 32 LEDs in a matrix of 16 in the horizontal direction and two in the vertical direction. To describe it in further detail, the upper light emitting unit 106 includes four LED packages 39 arranged horizontally in one row, and the lower light emitting unit 108 includes four LED packages 39 arranged horizontally in one row.

The upper light emitting unit 106 and the lower light emitting unit 108 are configured such that a gap G1 between the upper light emitting unit 106 and the light emitting part of the lower light emitting unit 108 is larger than the minimum gap G2 between horizontally adjacent semiconductor light emitting devices 38 in the upper light emitting unit 106 or the lower light emitting unit 108.

As shown in FIG. 13, the power feeding connectors 40*a* and 40*b* are provided on the top end of the upper part 36*a* and are connected to the semiconductor light emitting devices 38 by a power feeding circuit 42 formed on the circuit substrate 36. The power feeding circuit 42 is comprised of a plurality of wiring patterns 42*a* respectively corresponding to the semiconductor light emitting devices 38.

The connector units of wiring cords 48 connected to a control circuit 46 provided in the lamp chamber 18 are connected to the power feeding connectors 40*a* and 40*b*. Therefore, a power is supplied from the control circuit 46 to the semiconductor light emitting devices 38 via the wiring cords 48, the power feeding connectors 40, and the power feeding circuit 42. The control circuit 46 controls each group of the plurality of semiconductor light emitting devices 38 provided in the light emitting module 34 so as to turn them on or off.

Figure 14:
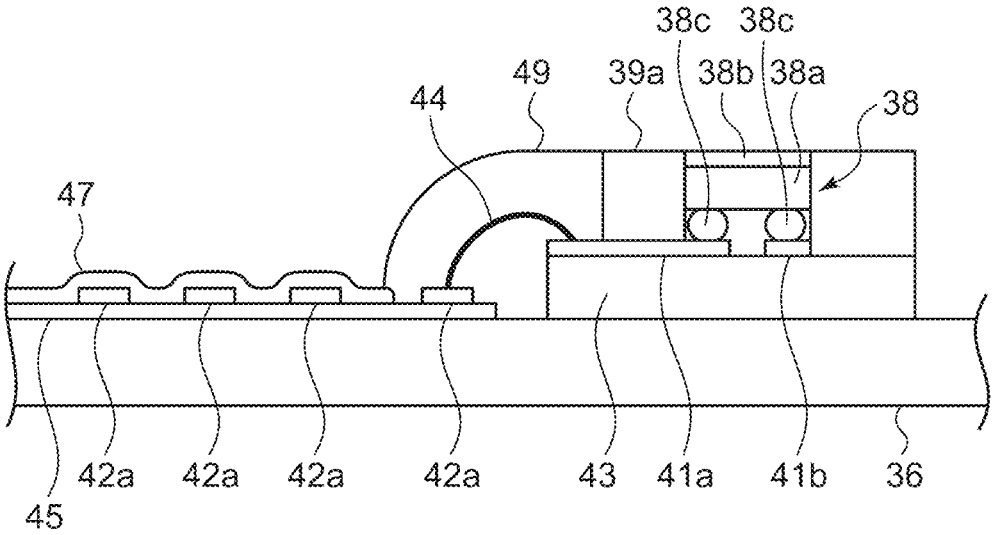
FIG. 14 is an X-X cross sectional view of FIG. 13.

FIG. 14 is an X-X cross sectional view of FIG. 13. The semiconductor light emitting device 38 according to this embodiment is configured such that a fluorescent layer 38*b* is formed on an LED chip 38*a* that embodies the semiconductor light emitting device 38 so as to emit white light. The plurality of semiconductor light emitting devices 38 are surrounded by a frame body 39*a* formed of white resin.

The LED chip 38*a* is connected to electrodes 41*a* and 41*b* via a bump 38*c*. The electrodes 41*a* and 41*b* are conductive members formed by patterning an aluminum nitride substrate 43. The wiring patterns 42*a* are formed on the circuit substrate 36 via an insulating layer 45. The top of the wiring patterns 42*a* is also coated with an insulating layer 47.

The electrode 41*a* is connected to an exposed portion of the wiring patterns 42*a* via a wire 44. The exposed portion of the wiring patterns 42*a* and the electrode 41*a*, along with the wire 44, are sealed by black resin 49. This inhibits the light emitted by the LED package 39 from being reflected or scattered by the black resin 49, thereby reducing glare.

When the light emitted from the LED chip 38*a* is incident, the fluorescent layer 38*b* transforms at least a portion of the incident light into a light of a different wavelength and projects the transformed light forward. For example, the fluorescent layer 38*b* may be manufactured by processing a ceramic phosphor into a plate shape. The fluorescent layer 38*b* may be manufactured by dispersing fluorescent powder in a transparent resin.

By employing an LED emitting blue light in the LED chip 38*a* and employing a phosphor that transforms blue light into yellow light in the fluorescent layer 38*b*, the semiconductor light emitting device 38 functions as a light source that radiates white light to a space in front of the vehicle.

A description will now be given of other members of the vehicle lamp 10. As shown in FIG. 11, a lower reflector 50 is provided below the semiconductor light emitting devices 38 forming the lower light emitting unit 108 mounted on the light emitting module 34, and an upper reflector 52 is provided above the semiconductor light emitting devices 38 forming the upper light emitting unit 106. Further, an intermediate reflector 51 is provided in an area between the upper light emitting unit 106 and the lower light emitting unit 108. The lower reflector 50 has a reflecting surface 50*a* facing substantially upward on the side facing the semiconductor light emitting devices 38. For example, the reflecting surface 50*a* is formed as a paraboloidal surface, hyperboloidal surface, or plane. Further, the upper reflector 52 has a reflecting surface 52*a* facing substantially downward on the side facing the semiconductor light emitting devices 38. For example, the reflecting surface 52*a* is formed as a paraboloidal surface, hyperboloidal surface, or plane. The reflecting surfaces 51*a* and 51*b* of the intermediate reflector 51 according to this embodiment has a planar shape. For example, a paraboloidal surface (concave curved surface), convex curved surface, formation of a step, etc. may be employed.

The reflecting surface 50*a*, the reflecting surfaces 51*a* and 51*b*, and the reflecting surface 52*a* reflect the light emitted from the semiconductor light emitting devices 38 forward. In this embodiment, the lower reflector 50, the intermediate reflector 51, and the upper reflector 52 are integrated as a reflecting member described later. The lower reflector 50, the intermediate reflector 51, and the upper reflector 52 function substantially similarly as the lower reflector 114, the intermediate reflector 118, and the upper reflector 124 described above.

A lens holder 62 is attached to the front face of the base part 26. The lens holder 62 has a cylindrical part 62*a* extending through in the longitudinal direction, foot parts 62*b* formed at three locations in the cylindrical part 62*a*, and fixing parts 62*c* formed at the ends of the foot parts 62*b*. The lens holder 62 is attached to the base part 26 via the fixing parts 62*c*.

A projection lens 64 is attached to the front end of the lens holder 62. The projection lens 64 is formed in a substantially semispherical shape such that the convex part thereof faces forward. The projection lens 64 has a function of an optical member for inverting an image on the focal plane including the back focal point and radiating and projecting the light emitted from the light emitting module 34 to a space in front of the vehicle. The projection lens 64 is housed in the lamp body 12 along with the light emitting module 34. Extension reflectors 65*a* and 65*b* are provided above and below the projection lens 64.

The light axis adjustment mechanism 24 has two aiming screws 66 and 68. The aiming screw 66 is provided toward the top and back of the lamp chamber 18 and has a rotational user manipulation part 66*a* and a shaft part 66*b* extending forward from the rotational user manipulation part 66*a*. A threaded groove 66*c* is formed toward the front end of the shaft part 66*b*.

The rotational user manipulation part 66*a* of the aiming screw 66 is rotatably supported by the back end of the lamp body 12 and the threaded groove 66*c* is threadably engaged with the supported part 28 toward the top of the holder member 22. When the rotational user manipulation part 66*a* is manipulated to rotate the aiming screw 66 joined to the supported part 28, the holder member 22 is inclined in a direction determined by the direction of rotation, with the other supported part 28 being a point of support. In this way, the light axis of the lamp unit 20 is adjusted (aiming control). The aiming screw 68 has a similar function.

A description will now be given of members that form the lamp unit 20.

(Holder Member)

Figure 15:
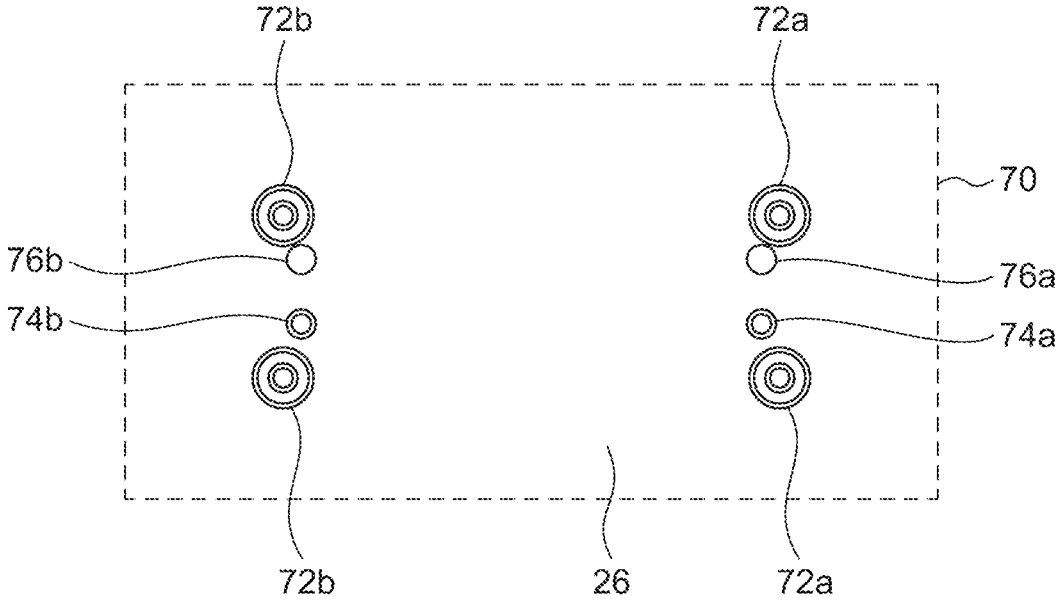
FIG. 15 is a front view of the center of the holder member viewed from a space in front.

The surface shape of the holder member shown in FIG. 12 will be described. FIG. 15 is a front view of the center of the holder member viewed from a space in front. A mount 70 shown in FIG. 15 is an area where the circuit substrate 36 shown in FIG. 13 is mounted. The mount 70 is provided with four cylindrical screw bosses 72*a*, 72*a*, 72*b*, and 72*b* (referred to as "screw bosses 72" as appropriate) projecting from the base part 26.

Toward the right of the mount 70, one positioning pin 74*a* and one hole 76*a* are provided to project from the base part 26 between the two screw bosses 72*a* adjacent to each other in the lateral direction. Similarly, toward the left of the mount 70, one positioning pin 74*b* and one hole 76*b* are provided to project from the base part 26 between the two screw bosses 72*b* adjacent to each other in the lateral direction.

(Circuit Substrate)

As shown in FIG. 13, a right end 36*d* and a left end 36*e* of the circuit substrate 36 are each formed with two notches 36*c*. Two round holes 78*a* and 78*b* that extend through the circuit substrate 36 are formed between the two notches 36*c* formed at the right end 36*d*. Further, two elongated holes 80*a* and 80*b* that extend through the circuit substrate 36 are formed between the two notches 36*c* formed at the left end 36*e*.

(Reflecting Member)

Figure 16:
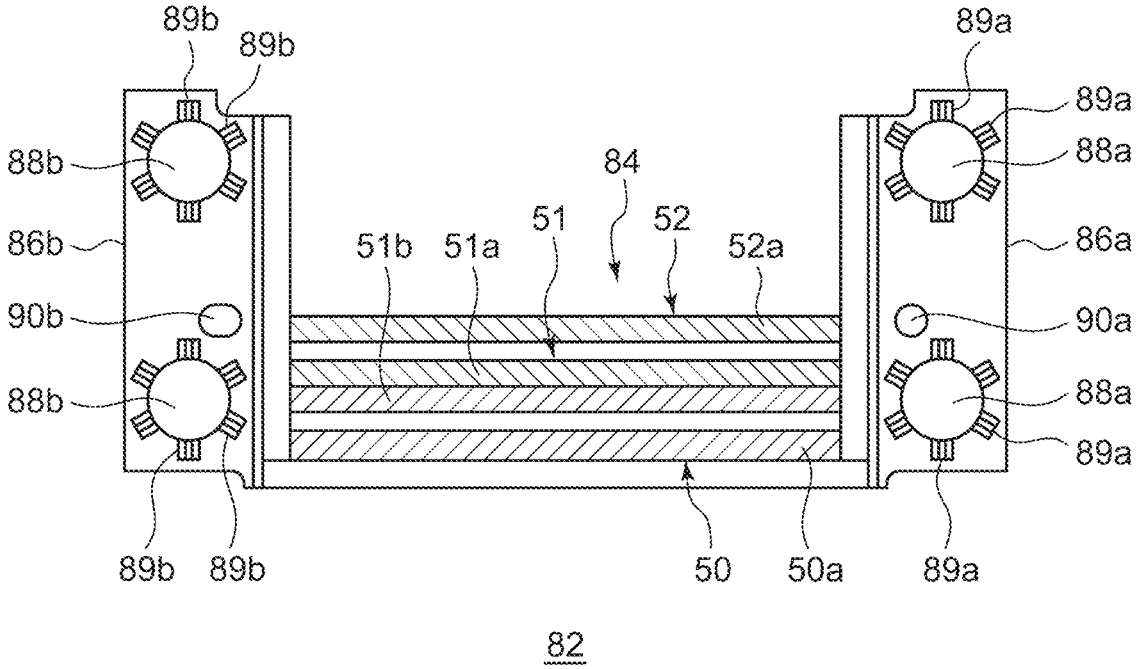
FIG. 16 is a front view of a reflecting member according to the embodiment.
Figure 17:
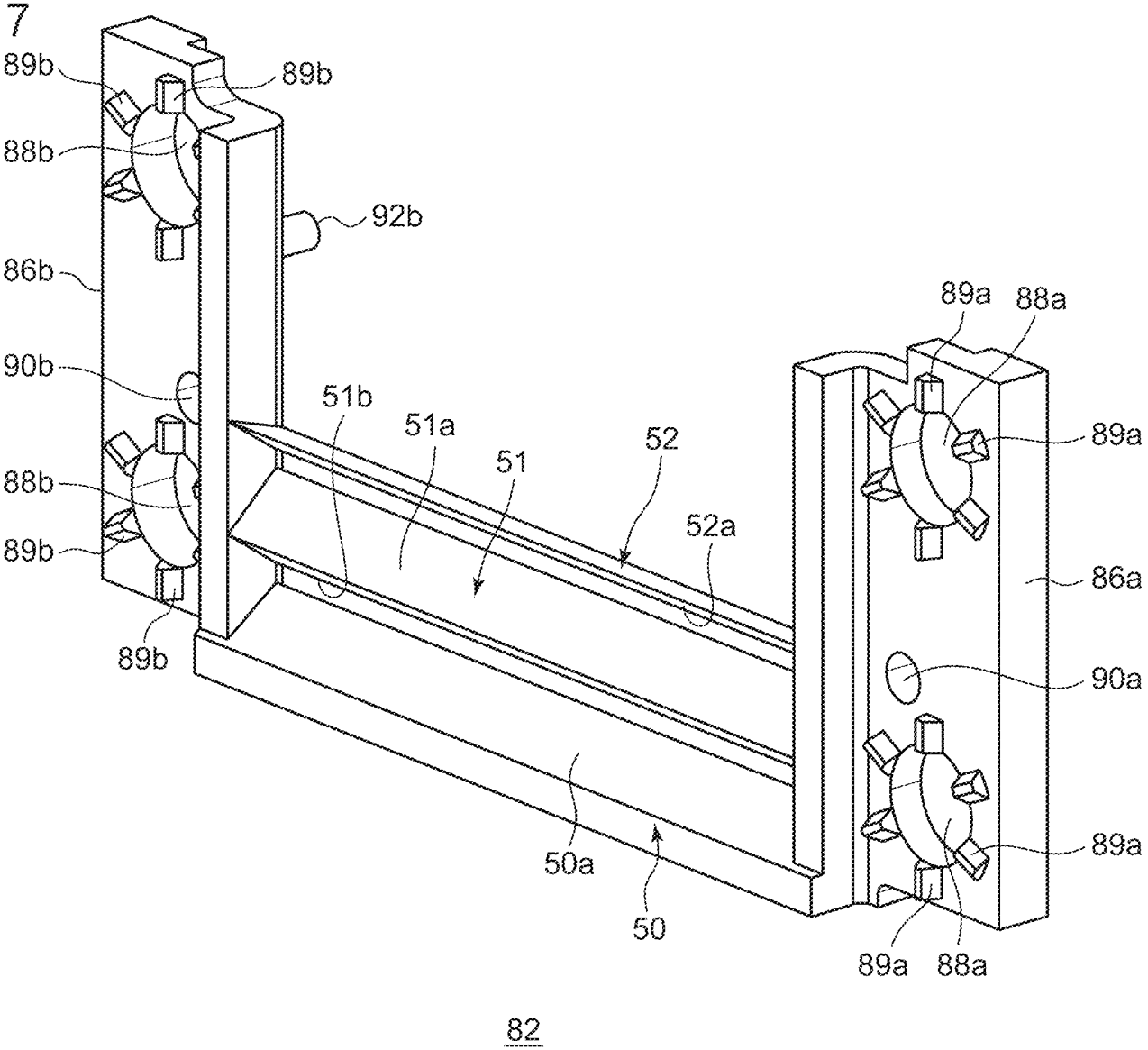
FIG. 17 is a front perspective view of the reflecting member according to the embodiment.

FIG. 16 is a front view of a reflecting member according to this embodiment. FIG. 17 is a front perspective view of the reflecting member according to this embodiment.

The reflecting member 82 is a component manufactured integrally by injection molding, using a thermoplastic resin such as high-heat polycarbonate (PC-HT) as a material. Further, the substrate of the reflecting member 82 is made of a transparent material. The material of the substrate preferably has a transmittance of 80% or higher.

The reflecting member 82 has a central reflecting part 84 provided with the lower reflector 50, the intermediate reflector 51, and the upper reflector 52, and a pair of fixing parts 86*a* and 86*b* provided to extend upward from the ends of the central reflecting part 84.

A metal reflecting film of aluminum etc. is formed on at least a portion of the surface including the reflecting surface 50*a*, of the lower reflector 50. Similarly, a metal reflecting film of aluminum etc. is formed on at least a portion of the surface including the reflecting surface 52*a*, of the upper reflector 52. The fixing parts 86*a* and 86*b* hold the right end 36*d* and the left end 36*e* of the light emitting module 34 from above as the light emitting module 34 is fixed to the circuit substrate 36.

The fixing part 86*a* is formed with two holes 88*a* in which the two screw bosses 72*a* and 72*a* of the base part 26 are fitted and with a round through hole 90*a*. Six convex parts 89*a* are formed around the front side of the hole 88*a* at substantially equal intervals. Further, a positioning pin (not shown) fitted in a round hole 78*a* of the light emitting module 34 is provided on the back surface side of the fixing part 86*a*.

Similarly, the fixing part 86*b* is formed with two holes 88*b* in which the two screw bosses 72*b* and 72*b* of the base part 26 are fitted and with an elongated through hole 90*b*. Six convex parts 89*b* are formed around the front side of the hole 88*b* at substantially equal intervals. Further, as shown in FIG. 17, a positioning pin 92*b* fitted in the elongated hole 80*a* of the light emitting module 34 is provided on the back surface side of the fixing part 86*b*.

(Assembly Method)

A description will now be given of a method of assembling the lamp unit 20 mainly with reference to FIG. 12.

First, the holder member 22 is prepared and coated with grease on its surface. The light emitting module 34 is then mounted on the holder member 22 such that the four notches 36*c* of the circuit substrate 36 of the light emitting module 34 are aligned with the positions of the four screw bosses 72 provided on the mount 70 of the holder member 22. In this process, the positioning pin 74*a* of the base part 26 is fitted in the round hole 78*b* of the circuit substrate 36. Further, the positioning pin 74*b* of the base part 26 (not shown in FIG. 12) is fitted in the elongated hole 80*b* of the circuit substrate 36. This positions the light emitting module 34 with respect to the holder member 22.

Next, the reflecting member 82 is then mounted on the holder member 22 so as to sandwich the light emitting module 34 such that the two holes 88*a* of the fixing part 86*a* and the two holes 88*b* of the fixing part 86*b* of the reflecting member 82 are aligned with the positions of the four screw bosses 72*a*, 72*a*, 72*b*, and 72*b* provided in the mount 70 of the holder member 22. In this process, the positioning pin 74*a* of the base part 26 is fitted in the round hole 90*a* of the fixing part 86*a*. Further, the positioning pin 74*b* (not shown in FIG. 12) of the base part 26 is fitted in the elongated hole 90*b* of the fixing part 86*b*.

In addition, the positioning pin (not shown) provided on the back surface side of the fixing part 86*a* is inserted into the round hole 78*a* of the circuit substrate 36 and the end thereof is fitted in the hole 76*a* provided in the base part 26. Further, the positioning pin 92*b* provided on the back surface side of the fixing part 86*b* is inserted into the elongated hole 80*a* of the circuit substrate 36 and the end thereof is fitted in the hole 76*b* provided in the base part 26. This positions the reflecting member 82 with respect to the light emitting module 34.

Next, four tapping screws 94 are guided through the four holes 88*a* and 88*b* formed in the reflecting member 82 and assembled to the four screw bosses 72*a*, 72*a*, 72*b*, and 72*b* of the holder member 22. This clamps the reflecting member 82 and the light emitting module 34 together with respect to the holder member 22. In this process, predetermined parts on the back surface side of the fixing parts 86*a* and 86*b* of the reflecting member 82 are configured to come into contact with the reference surface of the circuit substrate 36 of the light emitting module 34. This improves the precision of positioning the reflecting member 82 and the light emitting module 34.

The tapping screws 94 are screwed into the screw bosses 72*a* (or the screw bosses 72*b*) such that flanges thereof crush the convex parts 89*a* (or the convex parts 89*b*) formed around the front side of the hole 88*a* (or the hole 88*b*). In other words, the convex parts 89*a* and 89*b* function as margin for crushing. Because the convex parts 89*a* and 89*b* are crushed, variation in the relative positions of the tapping screws 94 and the screw bosses 72 is canceled even if there is unevenness in the thickness of the circuit substrate 36 of the light emitting module 34 and the position of the reflecting member 82 is displaced from the optimal position with respect to the holder member 22.

As described above, the light emitting module 34 is positioned and fixed relative to the holder member 22 such that the light emitting module 34 is positioned within the plane (vertical plane of the lamp unit) parallel to the surface of the holder member 22 by means of the positioning pins 74*a* and 74*b* formed in the holder member 22 and the round hole 78*b* and the elongated hole 80*b* formed in the circuit substrate 36. Further, the light emitting module 34 is positioned (fixed) in a direction (longitudinal direction of the vehicle) perpendicular to the surface of the holder member 22 such that the light emitting module 34 is sandwiched between the reflecting member 82 and the holder member 22 and clamped together in that state by the tapping screws 94.

This ensures that, so long as the round hole 78*b* and the elongated hole 80*b* are formed with precision, high precision in the dimension of the outer circumference of the circuit substrate 36 of the light emitting module 34 is not required. Therefore, the cost is prevented from increasing because formation of the round hole 78*b* and the elongated hole 80*b* does not accompany a considerable increase in the cost even if the size of the substrate is increased.

Further, since the light emitting module 34 is fixed to the holder member 22 by using the reflecting member 82 itself and without using a special fixing member, the number of components is reduced. Further, as compared with a case of directly fixing the light emitting module 34 to the holder member 22 by using a special fixing member (e.g., screw), there is no need for an area for screwing to the circuit substrate 36 so that the size of the circuit substrate 36 can be reduced.

Since the tapping screws 94 are caused to abut the screw bosses 72, the impact from a loose screw due to creep is reduced and the long lasting reliability of the positioning precision is ensured.

Further, since the reflecting member 82 is configured such that a predetermined grounded part thereof comes into contact with the reference surface of the circuit substrate 36 of the light emitting module 34, the reflecting member 82 and the light emitting module 34 are positioned with respect to each other directly. As a result, the precision of positioning the reflecting member 82 and the semiconductor light emitting devices 38 of the light emitting module 34 is improved.

Next, cords are attached to the power feeding connectors 40*a* and 40*b*. Subsequently, the lens holder 62 to which the projection lens 64 is fixed is fixed to the holder member 22. The base part 26 is formed with three screw bosses 96 and three positioning pins 98. Each of the positioning pins 98 is formed in the vicinity of the associated screw boss 96.

The three fixing parts 62*c* of the lens holder 62 are each formed with a hole 62*d* of a size that allows the threaded part of a tapping screw 100 to pass and a round hole 62*e* in which the positioning pin 98 of the holder member 22 is fitted. Six convex parts 62*f* are formed around the front side of the hole 62*d* at substantially equal intervals.

Next, three tapping screws 100 are guided through the holes 62*d* formed in the respective fixing parts 62*c* and assembled to the three screw bosses 96 of the holder member 22. In this process, the positioning pins 98 are fitted in the respective round holes 62*e* of the fixing parts 62*c*. This positions and fixes the lens holder 62 with respect to the holder member 22.

The tapping screws 100 are screwed into the screw bosses 96 such that flanges thereof crush the convex parts 62*f* formed around the front side of the holes 64*d*. In other words, the convex parts 62*f* function as margin for crushing. According to the method described above, the lamp unit 20 is assembled.

The lamp unit 20 provided in the vehicle lamp 10 as described above provides the same benefit and advantage as the lamp unit according to the first embodiment or the second embodiment.

Fourth Embodiment

Figure 18:
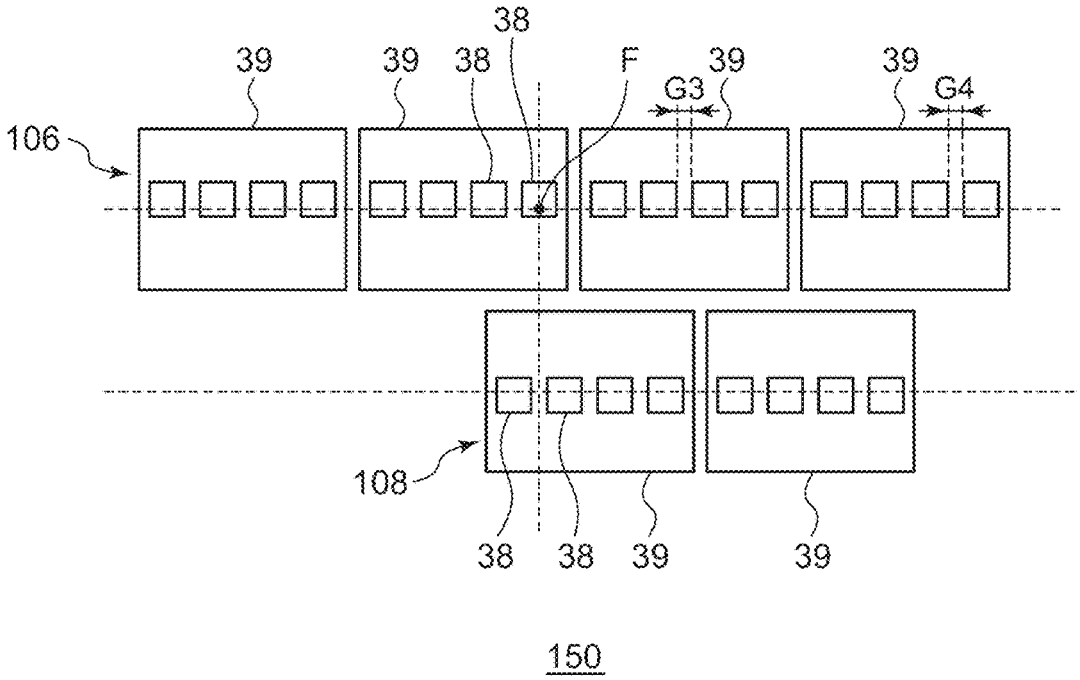
FIG. 18 is a front view of a light emitting module according to the fourth embodiment.

FIG. 18 is a front view of a light emitting module according to the fourth embodiment; As compared with the light emitting module 34 according to the third embodiment, a light emitting module 150 differs in the layout of the LED packages 39.

The upper light emitting unit 106 of the light emitting module 150 includes four LED packages 39 arranged horizontally, and the lower light emitting unit 108 includes two LED packages 39 arranged horizontally. The focal point F of the lens is located in front of one of the semiconductor light emitting devices 38 forming the upper light emitting unit 106 shown in FIG. 18 and is displaced from the horizontal center of the upper light emitting unit 106. The LED packages 39 are provided such that the semiconductor light emitting devices 38 forming the upper light emitting unit 106 and the semiconductor light emitting devices 38 forming the lower light emitting unit 108 are horizontally displaced from each other.

Unlike the case of the light emitting module 116 used in the lamp unit according to the first embodiment, the gap G3 between adjacent light emitting devices in the center is substantially identical to the gap G4 between adjacent light emitting devices at the horizontal ends in the upper light emitting unit 106 shown in FIG. 18. However, the gap G4 between adjacent light emitting devices at the horizontal ends may be configured to be larger than the gap G3 between adjacent light emitting devices in the center, as in the light emitting module 116 used in the lamp unit according to the first embodiment. In this way, a high-brightness area is formed in the center of the light distribution pattern, and, at the same time, the number of light emitting devices required to form a light distribution pattern of a desired extent can be reduced.

Reference Example 2

Figure 19:
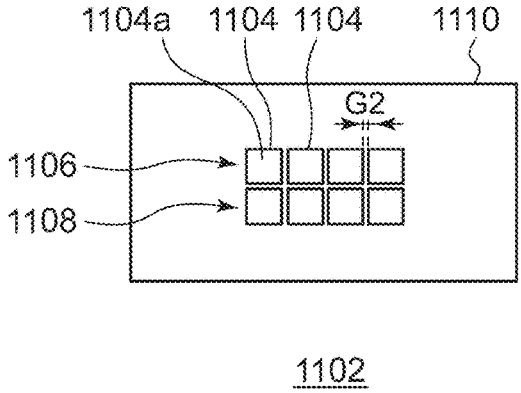
FIG. 19 is a front view of a light emitting module used in a lamp unit according to reference example 2.
Figure 20:
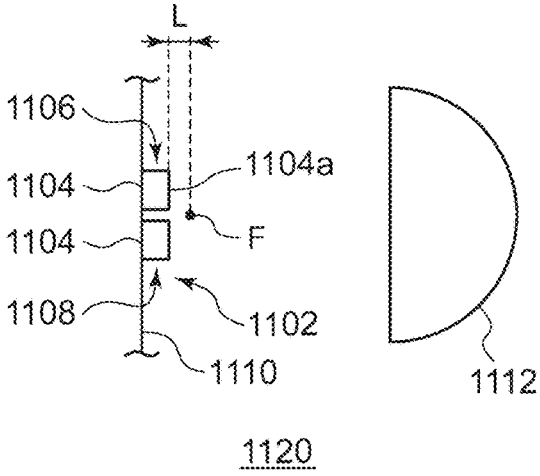
FIG. 20 is a side view of the lamp unit according to reference example 2.

A description will now be given of a problem of an optical system using an LED array as a light source. FIG. 19 is a front view of a light emitting module used in a lamp unit according to reference example 2. FIG. 20 is a side view of the lamp unit according to reference example 2.

As shown in FIG. 19, a light emitting module 1102 includes, in a front view, an upper light emitting unit 1106 in which a plurality of semiconductor light emitting devices 1104 are arranged horizontally in a row such that a light emitting surface 1104*a* faces the frontal direction, and a lower light emitting unit 1108 in which a plurality of semiconductor light emitting devices 1104 are arranged horizontally in a row such that a light emitting surface 1104*a* faces the frontal direction. The upper light emitting unit 1106 is provided toward the top of a substrate 1110, and the lower light emitting unit 1108 is provided more toward the bottom of the substrate 1110 than the upper light emitting unit 1106.

As shown in FIG. 20, the lamp unit 1120 includes the light emitting module 1102 and a projection lens 1112 configured to project images of the upper light emitting unit 1106 and the lower light emitting unit 1108 to a space in front of a vehicle. The focal point F of the projection lens 1112 is on the light axis of the lamp unit 1120 and is displaced toward the projection lens 1112 by about 1 mm (distance denoted by L in FIG. 20) from a plane including the light emitting surface 1104*a* of the semiconductor light emitting device 1104.

Figure 21:
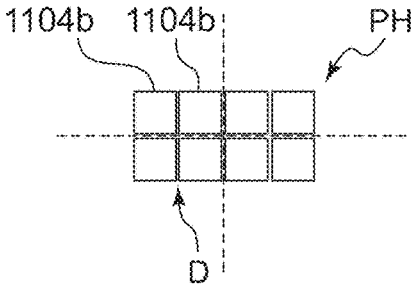
FIG. 21 shows a light distribution pattern produced when the upper light emitting unit and the lower light emitting unit are turned on in the lamp unit.

FIG. 21 shows a light distribution pattern produced when the upper light emitting unit 1106 and the lower light emitting unit 1108 are turned on in the lamp unit 1120.

The light distribution pattern PH shown in FIG. 21 includes an arrangement of projected images 1104*b* of the light emitting surfaces 1104*a* of the respective semiconductor light emitting device 1104. If there is a gap G2 between the light emitting surfaces 1104*a* of the respective semiconductor light emitting devices not emitting light, a dark section D is produced between the projected images 1104*b*. In other words, streaks of dark sections D that make bright and dark distinctively noticeable are formed in the light distribution pattern so that unevenness in light distribution is produced. For this reason, further improvements that make the dark section D less noticeable in the light distribution pattern comprised of the projected images of the light emitting surfaces of the light source will be necessary. We have arrived at a solution to make the dark section D less noticeable in the projected images by preventing images of the gaps between light emitting devices from being projected directly and clearly. A description will now be given of the feature of each embodiment.

Fifth Embodiment

Figure 22:
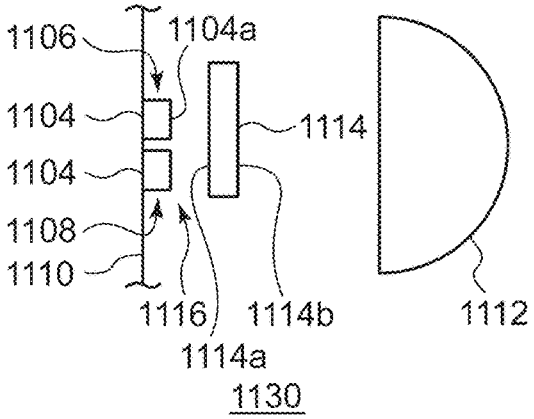
FIG. 22 is a side view of the lamp unit according to the fifth embodiment.

FIG. 22 is a side view of the lamp unit according to the fifth embodiment. Those components that are equivalent to the components of the lamp unit 1120 according to reference example 2 are denoted with the same reference numerals and a description thereof is omitted as appropriate.

As shown in FIG. 22, a light emitting module 1116 includes, in a front view, an upper light emitting unit 1106 and a lower light emitting unit 1108. The upper light emitting unit 1106 is provided toward the top of a substrate 1110, and the lower light emitting unit 1108 is provided more toward the bottom of the substrate 1110 than the upper light emitting unit 1106.

As shown in FIG. 22, the lamp unit 1130 is provided with the light emitting module 1116, a projection lens 1112, and a plate-shaped diffuser member 1114 provided between the light emitting module 1116 and the projection lens 1112. It is preferable that the diffuser member 1114 be formed of a material having certain scattering performance and a high transmittance and be shaped accordingly. For example, the preferable transmittance is about 85%から 90% in the wavelength range of 400 nmから 1100 nm (or visible light range). The material is exemplified by polycarbonate, acryl, glass, etc. Further, the incidence surface or the reflecting surface may be processed to form micro asperities. Alternatively, the diffuser member may include spaces that differ in refractivity by containing scatterers or bubbles inside.

The plurality of semiconductor light emitting devices 1104 are provided such that the light emitting surfaces 1104*a* of the light emitting devices face the diffuser member 1114. The light emitted from at least one of the upper light emitting unit 1106 and the lower light emitting unit 1108 is incident on an incidence surface 1114*a* of the diffuser member 1114 and exits from an exit surface 1114*b* toward the projection lens 1112.

Figure 23:
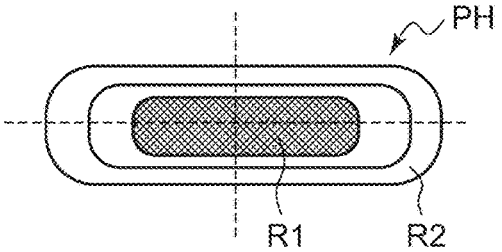
FIG. 23 shows a light distribution pattern produced when the upper light emitting unit and the lower light emitting unit are turned on in the lamp unit.

FIG. 23 shows a light distribution pattern produced when the upper light emitting unit 1106 and the lower light emitting unit 1108 are turned on in the lamp unit 1130. As mentioned above, at least a portion of the light entering the diffuser member 1114 is scattered (diffused) in the lamp unit 1130, making the streaks of the dark sections D corresponding to the gaps between the semiconductor light emitting devices 1104 less noticeable and reducing the unevenness in brightness (illuminance) in the light distribution pattern PH. The diffusing capability of the diffuser member 1114 is uniform in the lamp unit 1130 regardless of the location so that the brightness in the central area R1 of the light distribution PH is higher than that of the area R2 around.

As described above, the lamp unit 1120 according to the firth embodiment includes the light emitting module 1116 including the upper light emitting unit 1106 in which the plurality of semiconductor light emitting devices 1104 are arranged horizontally in a row and the lower light emitting unit 1108 in which the plurality of semiconductor light emitting devices 1104 are arranged horizontally in a row, the projection lens 1112 configured to project images of the upper light emitting unit 1106 and the lower light emitting unit 1108 to a space in front of the vehicle, and the diffuser member 1114 as an optical member provided between the light emitting module 1116 and the projection lens 1112. The light emitting module 1116 is provided such that light emitting surface thereof faces the incidence surface of the projection lens 1112. Further, the diffuser member 1114 is configured to change the light path of at least a portion of the incident light.

The lamp unit 1120, and the diffuser member 1114 provided between the light emitting module 1116 and the projection lens 1112 configured as described above make the dark sections caused by the gaps between the semiconductor light emitting devices 1104 less noticeable in the projected images when images of the upper light emitting unit 1106 and the lower light emitting unit 1108 are projected to a space in front of the vehicle. In other words, the dark sections can be blurred in the projected images.

Sixth Embodiment

Figure 24:
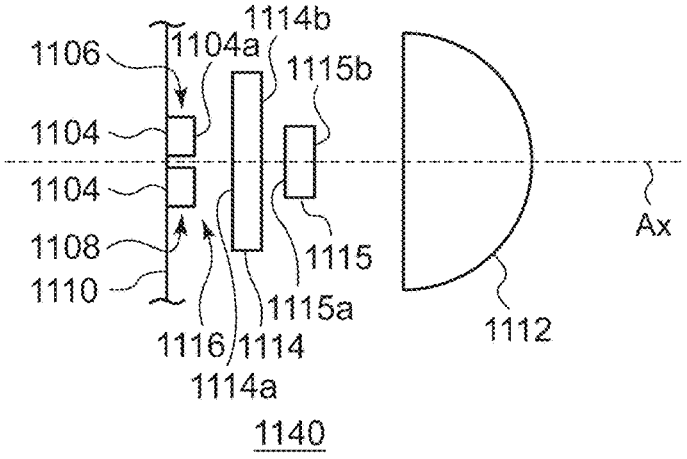
FIG. 24 is a side view of a lamp unit according to the sixth embodiment.
Figure 25:
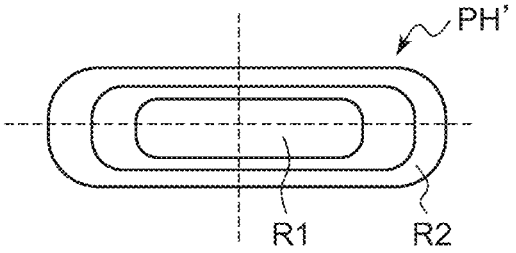
FIG. 25 shows a light distribution pattern produced when the upper light emitting unit and the lower light emitting unit are turned on in the lamp unit.

FIG. 24 is a side view of a lamp unit 1140 according to the sixth embodiment. FIG. 25 shows a light distribution pattern produced when the upper light emitting unit 1106 and the lower light emitting unit 1108 are turned on in the lamp unit 1140. Those components that are equivalent to the components of the lamp unit 1130 according to the fifth embodiment are denoted with the same reference numerals and a description thereof is omitted as appropriate.

As shown in FIG. 24, the lamp unit 1140 is provided with the light emitting module 1116, the projection lens 1112, and the plate-shaped diffuser member 1114 and a diffuser member 1115 provided between the light emitting module 1116 and the projection lens 1112. The diffuser member 1115 is provided between the diffuser member 1114 and the projection lens 1112. The diffuser member 1115 is a plate-shaped member having an incidence surface 1115*a* and an exit surface 1115*b* smaller than those of the diffuser member 1114 and has a function of diffusing a portion of the light diffused by the diffuser member 1114 again. Further, the diffuser member 1114 and the diffuser member 1115 are provided such that the central parts thereof intersect the light axis Ax.

This ensures that the light emitted from the highly luminous central area of the light emitting module 1116 is diffused by both the diffuser member 1114 and the diffuser member 1115. For this reason, the brightness (illuminance) in the central area R1 of the light distribution pattern PH' is reduced as compared with the light distribution pattern PH shown in FIG. 23, making the brightness in the area R2 around the central area R1 relatively higher. As a result, evenness of the brightness of the light distribution pattern PH' as a whole is increased.

The diffuser member 1115 may have a configuration similar to that of the diffuser member 1114. By devising the size, arrangement, shape, etc. of the diffuser member 1115 as appropriate and using it in combination with the diffuser member 1114, a desired light distribution pattern that cannot be obtained by using the diffuser member 1114 alone can be obtained.

Seventh Embodiment

Figure 26:
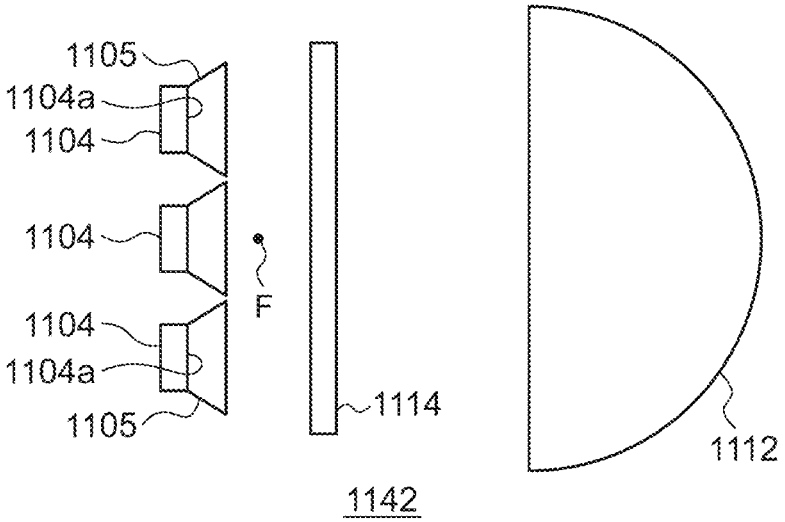
FIG. 26 is a side view of a lamp unit according to the seventh embodiment.

FIG. 26 is a side view of a lamp unit 1142 according to the seventh embodiment. As compared with the lamp unit 1130 according to the fifth embodiment, the lamp unit 1142 differs in that the number of rows of the semiconductor light emitting devices 1104 in the LED array is three, and an optical system 1105 is provided in front of the light emitting surface 1104*a* of each semiconductor light emitting device 1104. The optical system 1105 is a reflector, light guide, or ceramic phosphor or phosphor-containing resin in which a reflecting film is formed on surfaces other than the incidence surface and the exit surface, etc. This can ensure that the light emitted from the semiconductor light emitting devices 1104 is guided toward the diffuser member 1114 as much as possible so that the efficiency of using the light in the lamp unit 1142 is improved.

Eighth Embodiment

Figure 27:
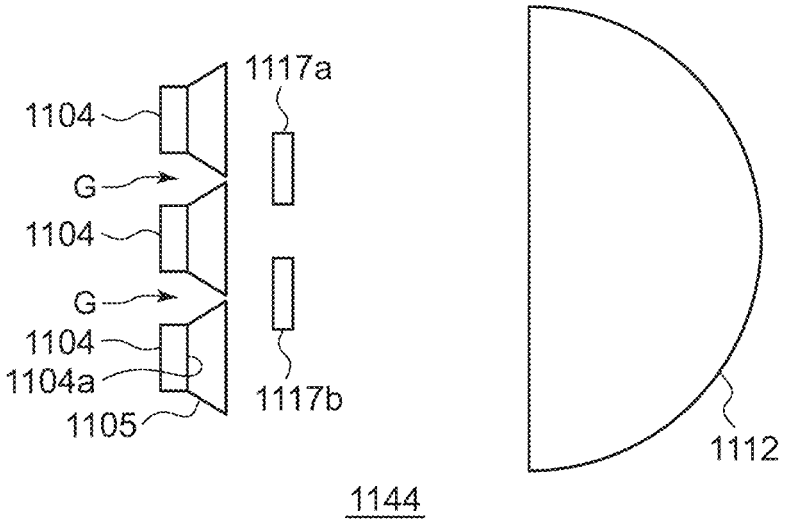
FIG. 27 is a side view of a lamp unit according to the eight embodiment.

FIG. 27 is a side view of a lamp unit 1144 according to the eight embodiment. As compared with the lamp unit 1142 according to the seventh embodiment, the lamp unit 1144 differs markedly in that diffuser members 1117*a* and 1117*b* are not provided to cover the entirety of the light emitting surface of the light emitting module and are provided in an area between the gaps G between the semiconductor light emitting devices 1104 and the projection lens 1112. In order to make the dark sections corresponding to the gaps G less noticeable, the gaps G should not be projected directly. Therefore, absorption of light in the diffuser member or wasteful diffusion not contributing to formation of a light distribution pattern are reduced by providing the diffuser members 1117*a* and 1117*b* in front of the gaps G and not providing diffuser members in front of the light emitting surfaces 1104*a* of the semiconductor light emitting devices 1104.

In other words, the diffuser members 1117*a* and 1117*b* in the lamp unit 1144 are provided between the area between the light emitting part in the first row and the light emitting part in the second row not emitting light, and the projection lens 1112. This can selectively blur the dark sections caused by the gaps G between the semiconductor light emitting devices 1104 in the projected images. In other words, those parts of the projected images directly representing the light emitting areas are not blurred so much.

Ninth Embodiment

Figure 28A:
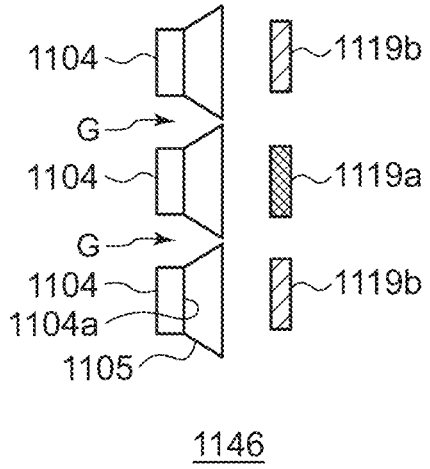
FIG. 28A is a side view of a lamp unit according to the ninth embodiment.
Figure 28B:
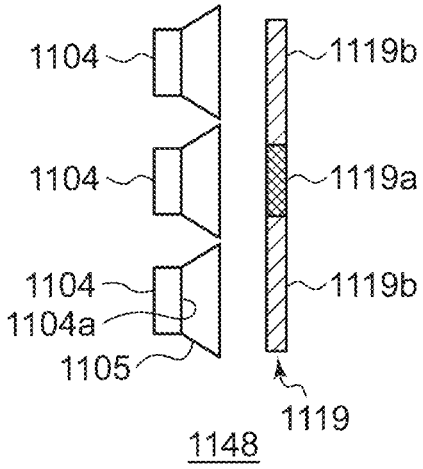
FIG. 28B is a side view of a lamp unit according to a variation of the ninth embodiment.

FIG. 28A is a side view of a lamp unit 1146 according to the ninth embodiment, and FIG. 28B is a side view of a lamp unit 1148 according to a variation of the ninth embodiment. In FIGS. 28A and 28B, illustration of the projection lens 1112 is omitted.

In the lamp unit 1146 shown in FIG. 28A, a diffuser member 1119*a* with a small diffusiveness (high diffuse transmittance) is provided in front of the light emitting surface 1104*a* of the semiconductor light emitting devices 1104 in the central row, and a diffuser member 1119*b* with a large diffusiveness (low diffuse transmittance) is provided in front of the light emitting surface 1104*a* of the semiconductor light emitting devices 1104 in the upper and lower rows. This makes the dark sections caused by the gaps G between the semiconductor light emitting devices 1104 less noticeable without lowering the brightness in the center of the light distribution pattern so much.

As in the lamp unit 1148 shown in FIG. 28B, the diffuser member 1119*a* and the diffuser member 1119*b* may be configured as a single plate-shaped diffuser member 1119. In other words, a distribution in diffusiveness may be produced by providing a single diffuser member 1119 with a plurality of areas that differ in diffusiveness. This can form bright sections and dark sections at desired positions in the light distribution pattern formed by projected images.

Reference Example 3

Figure 29:
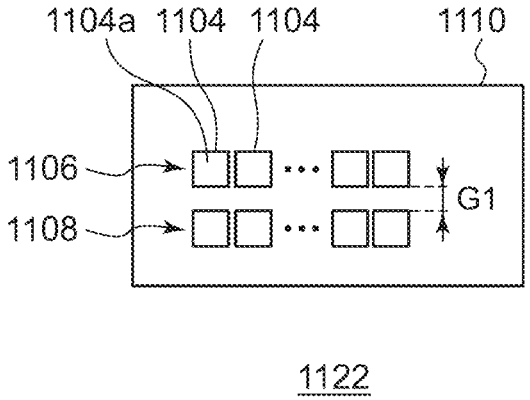
FIG. 29 is a front view of a light emitting module used in a lamp unit according to reference example 3.
Figure 30:
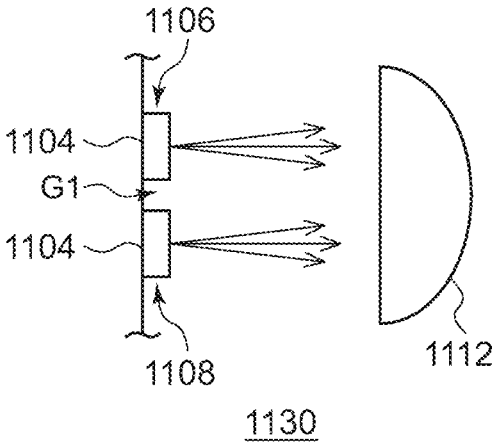
FIG. 30 is a side view of the lamp unit according to reference example 3.
Figure 31:
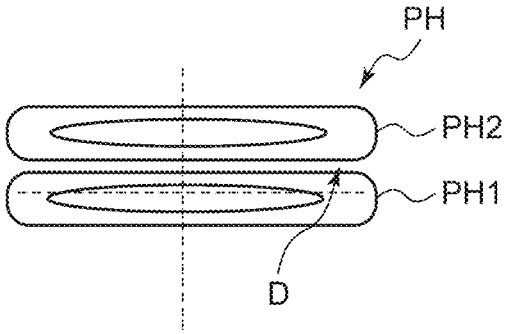
FIG. 31 shows a light distribution pattern produced when the upper light emitting unit and the lower light emitting unit are turned on in the lamp unit.

A description will now be given of another problem of an optical system using an LED array as a light source. FIG. 29 is a front view of a light emitting module used in a lamp unit according to reference example 3. FIG. 30 is a side view of the lamp unit according to reference example 3. FIG. 31 shows a light distribution pattern produced when the upper light emitting unit 1106 and the lower light emitting unit 1108 are turned on in the lamp unit 1130.

A light emitting module 1122 and the lamp unit 1130 are configured similarly as in the foregoing embodiments so that a description is omitted as appropriate. The light distribution pattern PH shown in FIG. 31 includes a light distribution pattern PH1 and a light distribution pattern PH2, the light distribution pattern PH1 being a lower area of the light distribution pattern PH illuminated by the upper light emitting unit 1106, and the light distribution pattern PH2 being an upper area of the light distribution pattern PH illuminated by the lower light emitting unit 1108. The dark section D corresponding to the gap G1 between the upper light emitting unit 1106 and the lower light emitting unit 1108 is formed in the light distribution pattern PH, creating unevenness in the light distribution. We have arrived at a solution to make the dark section D less noticeable in the projected images by preventing an image of the gap G1 between upper light emitting unit 1106 and the lower light emitting unit 1108 from being projected directly and clearly.

Tenth Embodiment

Figure 32:
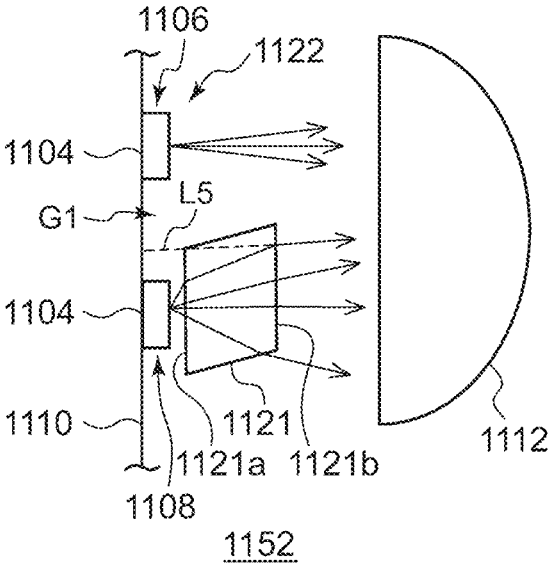
FIG. 32 is a side view of a lamp unit according to the tenth embodiment.
Figure 33:
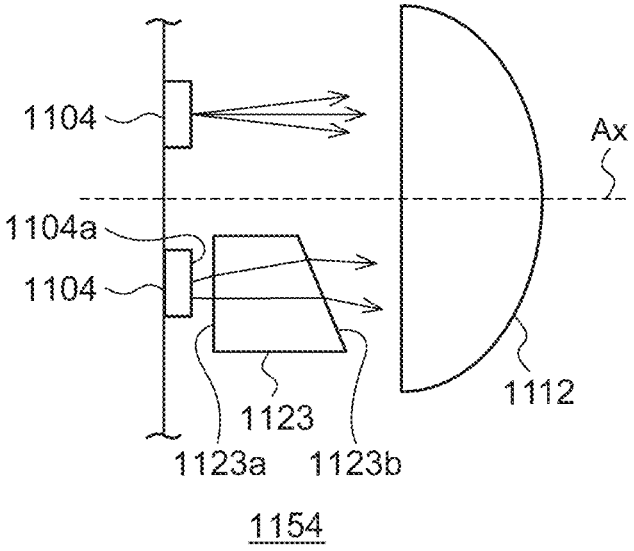
FIG. 33 is a side view of the lamp unit according to variation of the tenth embodiment.
Figure 34:
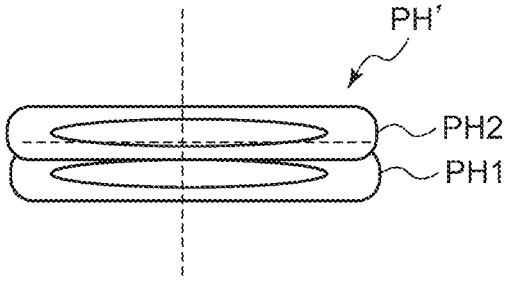
FIG. 34 shows a light distribution pattern produced when the upper light emitting unit and the lower light emitting unit are turned on in the lamp unit according to the tenth embodiment.

In the following embodiments, a light guide is described as exemplifying an optical member configured to change the light path of at least a portion of the incident light. FIG. 32 is a side view of a lamp unit according to the tenth embodiment. FIG. 33 is a side view of the lamp unit according to a variation of the tenth embodiment. Those components that are equivalent to the components of the lamp unit 1130 according to reference example 3 are denoted with the same reference numerals and a description thereof is omitted as appropriate. FIG. 34 shows a light distribution pattern produced when the upper light emitting unit 1106 and the lower light emitting unit 1108 are turned on in the lamp unit according to the tenth embodiment.

A lamp unit 1152 has the light emitting module 1122, the projection lens 1112, and a columnar light guide 1121. The light guide 1121 is a member shaped in a rectangular column having a parallelogram cross section and is configured as a transparent member made of glass, ceramic, resin, or the like. The light guide 1121 may include a phosphor.

The light guide 1121 is provided in front of the light emitting surface 1104*a* of the semiconductor light emitting devices 1104 of the lower light emitting unit 1108. The light guide 1121 is shaped so that the light is refracted on an incidence surface 1121*a* on which a portion of the light emitted from the light emitting module 1122 is incident or on an exit surface 1121*b* from which the transmitted light exits. The areas and shapes of the incidence surface 1121*a* and the exit surface 1121*b* of the light guide 1121 are substantially identical.

In the lamp unit 1152 according to this embodiment, the light guide 1121 provided in front of the lower light emitting unit 1108 refracts a portion of the light emitted from the lower light emitting unit 1108 and guides the refracted light toward the projection lens 1112. Therefore, it appears that light is emitted from the area corresponding to the gap G1 and not emitting light, even if the gap G1 between the upper light emitting unit 1106 and the lower light emitting unit 1108 is large (see the light L5 in FIG. 32). Therefore, the area not emitting light is inhibited from directly showing itself as a dark section in a portion of the light distribution pattern PH.

In other words, the light distribution pattern PH' shown in FIG. 34 includes a light distribution pattern PH1 and a light distribution pattern PH2 overlapping each other in part, the light distribution pattern PH1 being a lower area of the light distribution pattern PH illuminated by the upper light emitting unit 1106, and the light distribution pattern PH2 being an upper area of the light distribution pattern PH illuminated by the lower light emitting unit 1108. Therefore, the dark section D is less noticeable than in the light distribution pattern PH shown in FIG. 31. In other words, the dark section caused by the gaps G1 between the semiconductor light emitting devices 1104 is less noticeable and unevenness in light distribution is reduced.

The light guide may be shaped to have a trapezoidal cross section like the light guide 1123 in the lamp unit 1154 shown in FIG. 33. An incidence surface 1123*a* of the light guide 1123 is substantially parallel to the light emitting surface 1104*a* of the semiconductor light emitting device 1104, and an exit surface 1123*b* of the light guide 1123 is arranged to intersect the light axis Ax.

The characteristics of the light distribution patterns formed by the lamp unit 1130 shown in FIG. 30, the lamp unit 1152 shown in FIG. 32, and the lamp unit 1154 shown in FIG. 33 will now be compared with reference to a simulation. In this simulation, a light emitting module in which the number of light emitting devices in the lower light emitting unit 1108 is smaller than the number of light emitting devices in the upper light emitting unit 1106 is used. Consequently, the horizontally width of the illuminated area in the upper half of the light distribution pattern is relatively small.

Figure 35A:
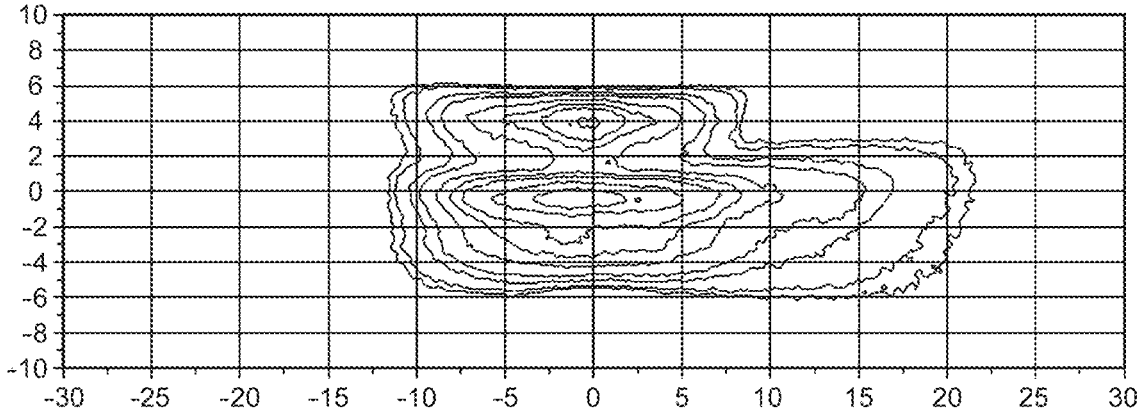
FIG. 35A shows a light distribution pattern formed by the lamp unit shown in FIG. 30.
Figure 35B:
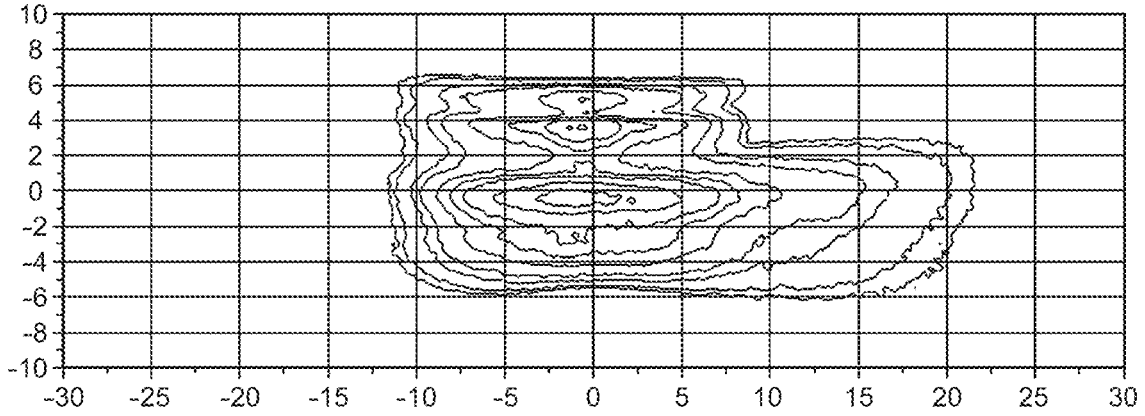
FIG. 35B shows a light distribution pattern formed by the lamp unit shown in FIG. 32.
Figure 35C:
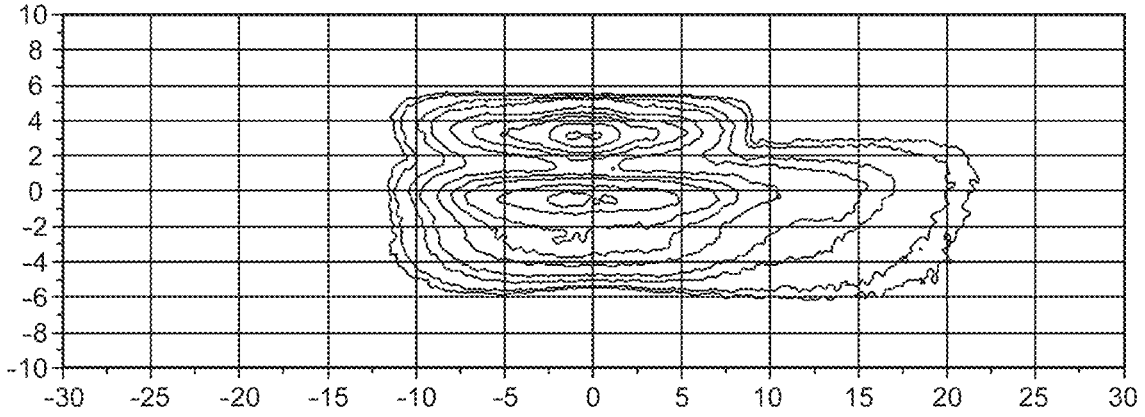
FIG. 35C shows a light distribution pattern formed by the lamp unit shown in FIG. 33.

FIG. 35A shows a light distribution pattern formed by the lamp unit 1130 shown in FIG. 30, FIG. 35B shows a light distribution pattern formed by the lamp unit 1152 shown in FIG. 32, and FIG. 35C shows a light distribution pattern formed by the lamp unit 1154 shown in FIG. 33.

Figure 36:
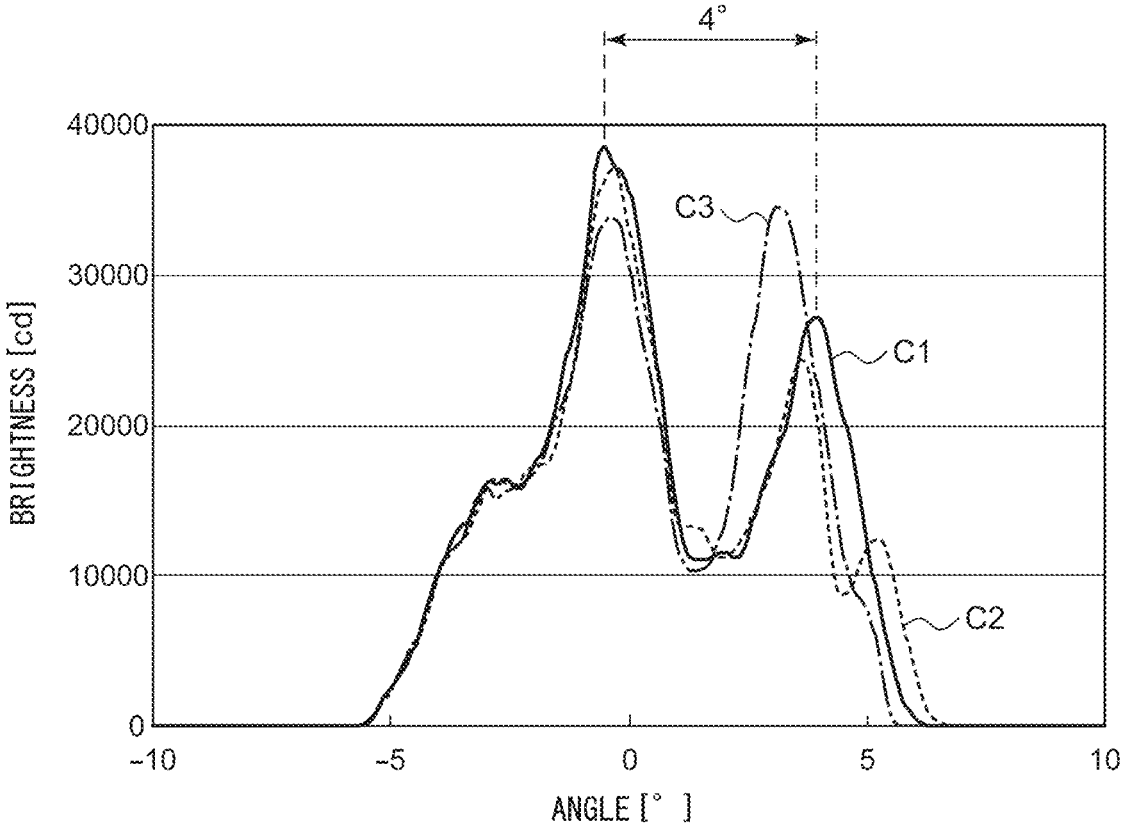
FIG. 36 is a chart showing the brightness distribution of the light distribution patterns shown in FIGS. 35A-35C in the V (vertical) direction.

FIG. 36 is a chart showing brightness distribution of the light distribution patterns shown in FIGS. 35A-35C in the V (vertical) direction. The curve C1 shown in FIG. 36 indicates the brightness distribution of the light distribution pattern formed by the lamp unit 1130 shown in FIG. 30, the curve C2 shown in FIG. 36 indicates the brightness distribution of the light distribution pattern formed by the lamp unit 1152 shown in FIG. 32, and the curve C3 shown in FIG. 36 indicates the brightness distribution of the light distribution pattern formed by the lamp unit 1154 shown in FIG. 33.

The result shown in FIG. 36 reveals that there is a vertical spread of about 4° between the positions of two brightness peaks corresponding to the upper light emitting unit 1106 and the lower light emitting unit 1108 in the lamp unit 1130 not provided with a light guide. However, the positions of two brightness peaks in the lamp unit provided with a light guide are closer to each other in the vertical direction than in the case without a light guide. In particular, the spread between the positions of two brightness peaks in the lamp unit 1154 provided with the light guide 1123 is reduced to about 3° in the vertical direction, indicating that dark sections are smaller and unevenness in light distribution is reduced.

Eleventh Embodiment

In the eleventh embodiment, a description will be given of a vehicle lamp to which the lamp module according to the fifth through tenth embodiments can be applied.

Figure 37:
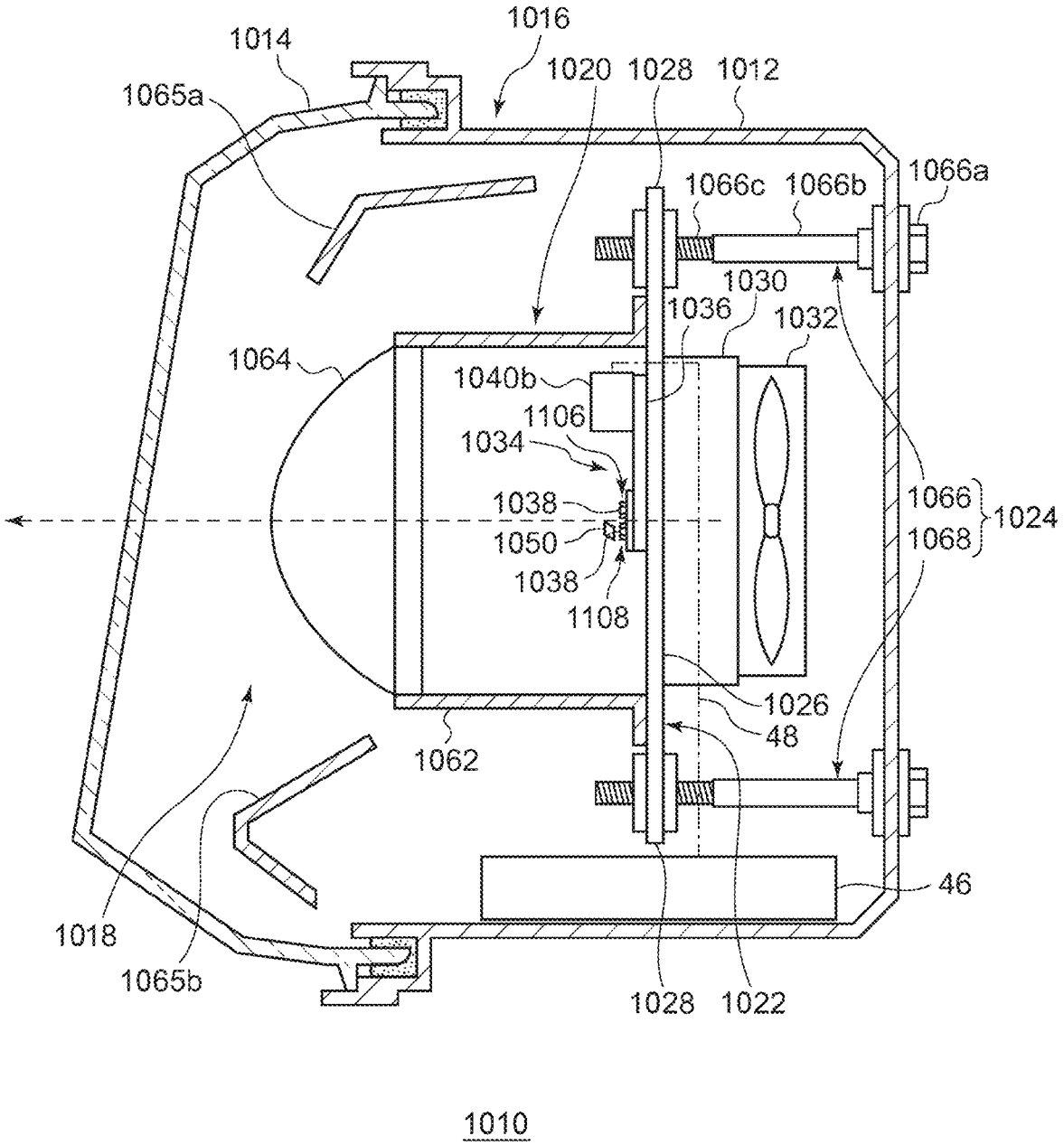
FIG. 37 shows a schematic longitudinal cross section of a vehicle lamp according to the eleventh embodiment.
Figure 38:
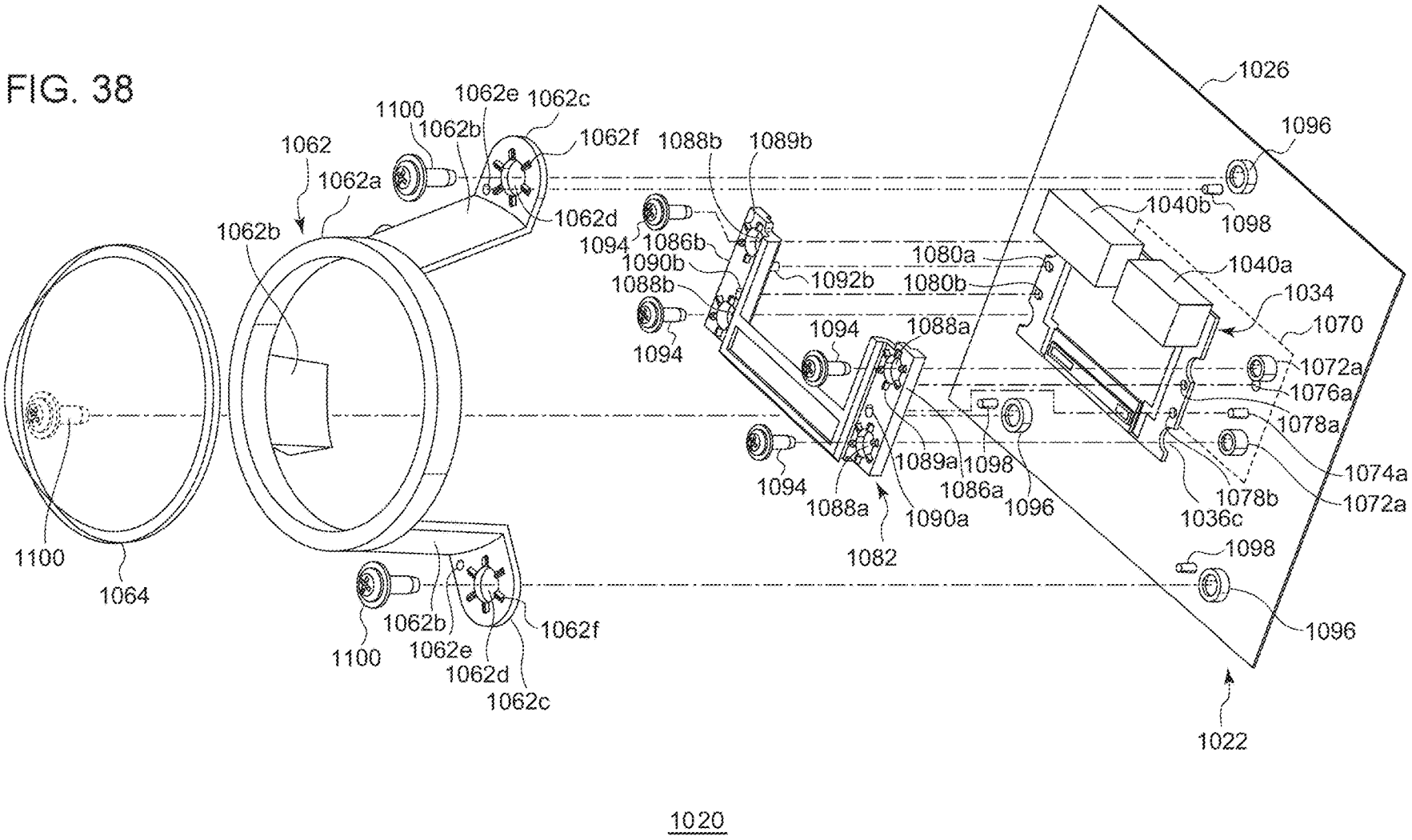
FIG. 38 is an exploded perspective view of a lamp unit shown in FIG. 37.

FIG. 37 shows a schematic longitudinal cross section of a vehicle lamp according to the eleventh embodiment. FIG. 38 is an exploded perspective view of a lamp unit 1020 shown in FIG. 37. A vehicle lamp 1010 shown in FIG. 37 functions as a headlamp used in a vehicle.

The vehicle lamp 1010 is provided at the left and right ends of the front of the vehicle. As shown in FIG. 37, the vehicle lamp 1010 is provided with a lamp body 1012 that opens to a space in front and a front cover 1014 fitted to the open front part of the lamp body 1012. The lamp body 1012 and the front cover 1014 form a lamp housing 1016. A lamp chamber 1018 is formed in the lamp housing 1016.

The lamp unit 1020 is provided in the lamp chamber 1018. The lamp unit 1020 is configured to form a light distribution pattern for a high beam. A holder member 1022 is also provided in the lamp chamber 1018. A light axis adjustment mechanism 1024 is configured to move the holder member 1022 so as to be inclined in the transversal direction or the longitudinal direction as desired. The holder member 1022 is made of a metal material having a high thermal conductivity and has a base part 1026 that faces the longitudinal direction. The holder member 1022 functions as part of a heat sink.

The base part 1026 is provided with supported parts 1028, 1028, 1028 on the upper and lower ends thereof (in FIG. 37, only two supported parts 1028, 1028 are shown). A heat dissipating fin 1030 is provided on the back surface of the base part 1026 to project backward. A heat dissipating fan 1032 is attached to the back surface of the heat dissipating fin 1030.

The light emitting module 1034 is attached to an area from the center to the top on the font face of the base part 1026. The light emitting module 1034 is configured to be similar to the light emitting module 34 shown in FIG. 13 so that a description thereof is omitted as appropriate.

A description will now be given of other members of the vehicle lamp 1010. A light guide 1050 is positioned in front of semiconductor light emitting devices 1038 forming the lower light emitting unit 1108 mounted on the light emitting module 1034. The schematic configuration, and advantage and benefit of the lamp unit 1020 including the light guide 1050 substantially encompass the configuration, and advantage and benefit of the lamp unit 1152 according to the tenth embodiment so that a description thereof is omitted.

A lens holder 1062 is attached to the front face of the base part 1026. The lens holder 1062 has a cylindrical part 1062*a* extending through in the longitudinal direction, foot parts 1062*b* formed at three locations in the cylindrical part 1062*a*, and fixing parts 1062*c* formed at the ends of the foot parts 1062*b*. The lens holder 1062 is attached to the base part 1026 via the fixing parts 1062*c*.

A projection lens 1064 is attached to the front end of the lens holder 1062. The projection lens 1064 is formed in a substantially semispherical shape such that the convex part thereof faces forward. The projection lens 1064 has a function of an optical member for inverting an image on the focal plane including the back focal point and radiating and projecting the light emitted from the light emitting module 1034 to a space in front of the vehicle. The projection lens 1064 is housed in the lamp body 1012 along with the light emitting module 1034. Extension reflectors 1065*a* and 1065*b* are provided above and below the projection lens 1064.

The light axis adjustment mechanism 1024 has two aiming screws 1066 and 1068. The aiming screw 1066 is provided toward the top and back of the lamp chamber 1018 and has a rotational user manipulation part 1066*a* and a shaft part 1066*b* extending forward from the rotational user manipulation part 1066*a*. A threaded groove 1066*c* is formed toward the front end of the shaft part 1066*b*.

The rotational user manipulation part 1066*a* of the aiming screw 1066 is rotatably supported by the back end of the lamp body 1012 and the threaded groove 1066*c* is threadably engaged with the supported part 1028 toward the top of the holder member 1022. When the rotational user manipulation part 1066*a* is manipulated to rotate the aiming screw 1066 joined to the supported part 1028, the holder member 1022 is inclined in a direction determined by the direction of rotation, with the other supported part 1028 being a point of support. In this way, the light axis of the lamp unit 1020 is adjusted (aiming control). The aiming screw 1068 has a similar function.

A description will now be given of members that form the lamp unit 1020.

(Holder Member)

The surface shape of the holder member 1022 shown in FIG. 38 is configured to be similar to that of the mount 70 shown in FIG. 15 so that a description thereof is omitted as appropriate.

(Circuit Substrate)

The circuit substrate 1036 is configured to be similar to the circuit substrate 36 shown in FIG. 13 so that a description thereof is omitted as appropriate.

(Optical System Holder Member)

Figure 39:
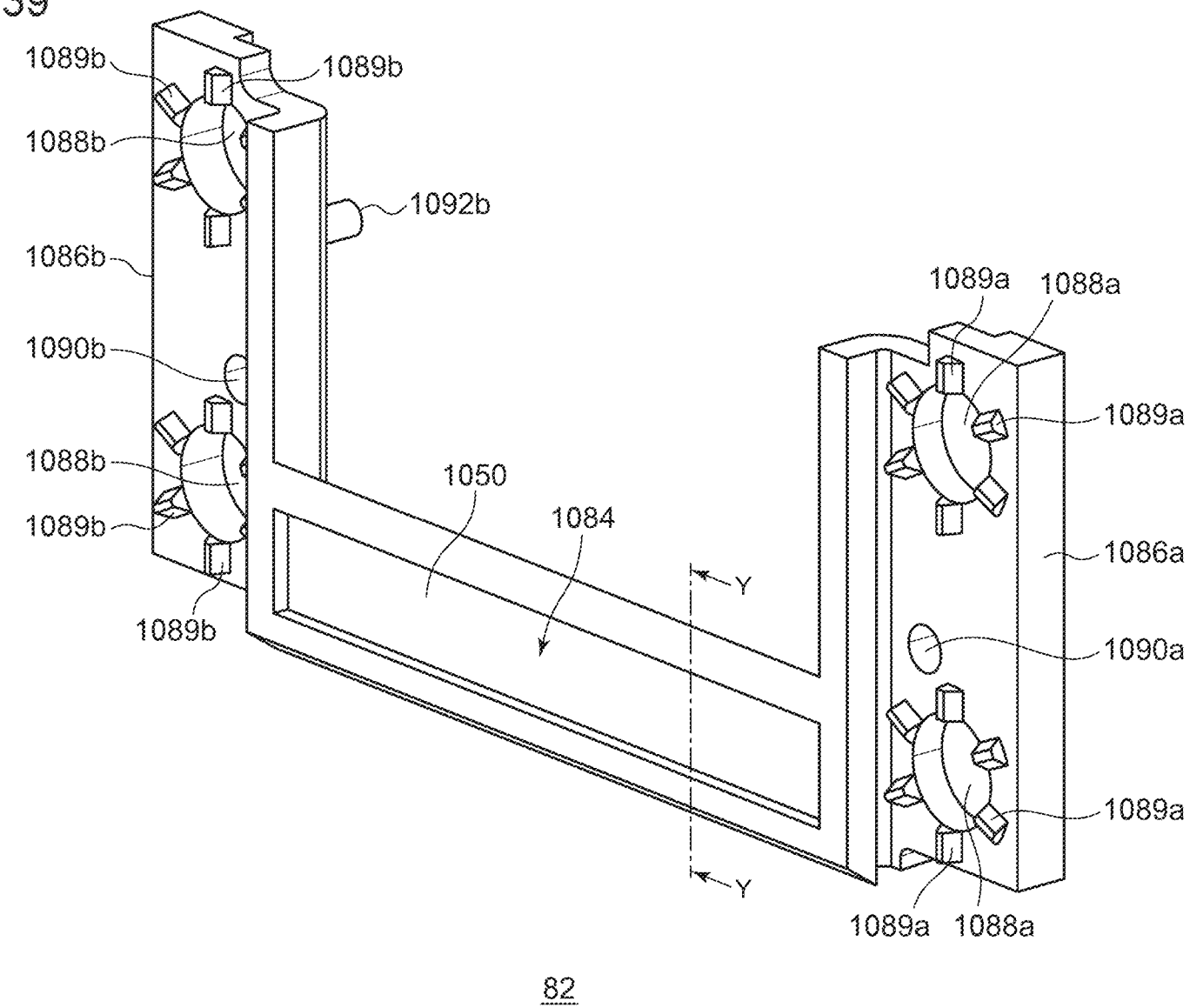
FIG. 39 is a front view of an optical system holder member according to the embodiment.
Figure 40:
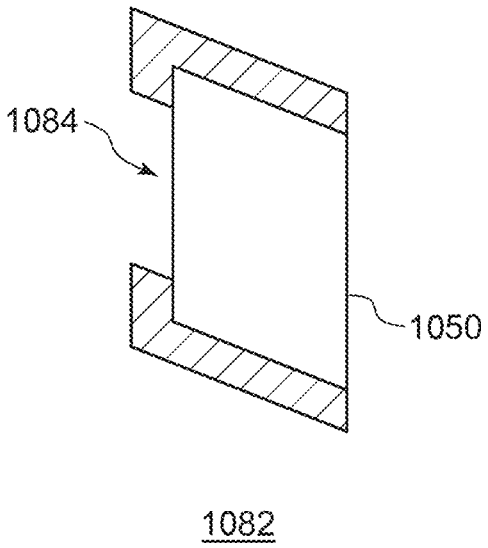
FIG. 40 is a Y-Y cross sectional view of the optical system holder member shown in FIG. 39.

FIG. 39 is a front view of an optical system holder member 1082 according to this embodiment. FIG. 40 is a Y-Y cross sectional view of the optical system holder member 1082 shown in FIG. 39.

The optical system holder member 1082 is a component manufactured integrally by injection molding, using a thermoplastic resin such as high-heat polycarbonate (PC-HT) as a material. Further, the substrate of the optical system holder member 1082 is made of a transparent material. The material of the substrate preferably has a transmittance of 80% or higher.

The optical system holder member 1082 has a central opening 1084 in which the light guide 1050 in a square column shape is mounted, and a pair of fixing parts 1086*a* and 1086*b* provided to extend upward from the ends of the central opening 1084.

The fixing parts 1086*a* and 1086*b* hold the right end 36*d* (see FIG. 13) and left end 36*e* (see FIG. 13) of the light emitting module 1034 from above as the light emitting module 1034 is fixed to the circuit substrate 1036.

The fixing part 1086*a* is formed with two holes 1088*a* in which the two screw bosses 1072*a* and 1072*a* of the base part 1026 are fitted and with a round through hole 1090*a*. Six convex parts 1089*a* are formed around the front side of the hole 1088*a* at substantially equal intervals. Further, a positioning pin (not shown) fitted in a round hole 1078*a* of the light emitting module 1034 is provided on the back surface side of the fixing part 1086*a*.

Similarly, the fixing part 1086*b* is formed with two holes 1088*b* in which the two screw bosses 72*b* and 72*b* (see FIG. 15) of the base part 1026 are fitted and with an elongated through hole 1090*b*. Six convex parts 1089*b* are formed around the front side of the hole 1088*b* at substantially equal intervals. Further, as shown in FIG. 39, a positioning pin 1092*b* fitted in the elongated hole 1080*a* of the light emitting module 1034 is provided on the back surface side of the fixing part 1086*b*.

(Assembly Method)

A description will now be given of a method of assembling the lamp unit 1020 mainly with reference to FIG. 38.

First, the holder member 1022 is prepared and coated with grease on its surface. The light emitting module 1034 is then mounted on the holder member 1022 such that the four notches 36*c* (see FIG. 13) of the circuit substrate 1036 of the light emitting module 1034 are aligned with the positions of the four screw bosses (similar to the screw bosses 72*a* and 72*b* shown in FIG. 15) provided on a mount 1070 of the holder member 1022. In this process, the positioning pin 1074*a* of the base part 1026 is fitted in the round hole 1078*b* of the circuit substrate 1036. Further, the positioning pin 74*b* of the base part 1026 (see FIG. 15) is fitted in the elongated hole 1080*b* of the circuit substrate 1036. This positions the light emitting module 1034 with respect to the holder member 1022.

Next, the optical system holder member 1082 is mounted on the holder member 1022 so as to sandwich the light emitting module 1034 such that two holes 1088*a* of the fixing part 1086*a* and the two holes 1088*b* of the fixing part 1086*b* of the optical system holder member 1082 are aligned with the positions of the four screw bosses provided in the mount 1070 of the holder member 1022. In this process, the positioning pin 1074*a* of the base part 1026 is fitted in the round hole 1090*a* of the fixing part 1086*a*. Further, the positioning pin 74*b* of the base part 1026 (see FIG. 15) is fitted in the elongated hole 1090*b* of the fixing part 1086*b*.

In addition, the positioning pin (not shown) provided on the back surface side of the fixing part 1086*a* is inserted into the round hole 1078*a* of the circuit substrate 1036 and the end thereof is fitted in a hole 1076*a* provided in the base part 1026. Further, the positioning pin 1092*b* provided on the back surface side of the fixing part 1086*b* is inserted into the elongated hole 1080*a* of the circuit substrate 1036 and the end thereof is fitted in the hole 76*b* (see FIG. 15) provided in the base part 1026. This positions the optical system holder member 1082 with respect to the light emitting module 1034.

Next, four tapping screws 1094 are guided through the four holes 1088*a* and 1088*b* formed in the optical system holder member 1082 and assembled to the four screw bosses 1072*a*, 1072*a*, 72*b*, and 72*b* (see FIG. 15) of the holder member 1022. This clamps the optical system holder member 1082 and the light emitting module 1034 together with respect to the holder member 1022. In this process, predetermined parts on the back surface side of the fixing parts 1086*a* and 1086*b* of the optical system holder member 1082 are configured to come into contact with the reference surface of the circuit substrate 1036 of the light emitting module 1034. This improves the precision of positioning the optical system holder member 1082 and the light emitting module 1034.

The tapping screws 1094 are screwed into the screw bosses 1072*a* (or the screw bosses 72*b*) such that flanges thereof crush the convex parts 1089*a* (or the convex parts 1089*b*) formed around the front side of the hole 1088*a* (or the hole 1088*b*). In other words, the convex parts 1089*a* and 1089*b* function as margin for crushing. Because the convex parts 1089*a* and 1089*b* are crushed, variation in the relative positions of the tapping screws 1094 and the screw bosses 1072*a*, 72*b* is canceled even if there is variation in the thickness of the circuit substrate 1036 of the light emitting module 1034 and the position of the optical system holder member 1082 is displaced from the optimal position with respect to the holder member 1022.

As described above, the light emitting module 1034 is positioned and fixed relative to the holder member 1022 such that the light emitting module 1034 is positioned within the plane (vertical plane of the lamp unit) parallel to the surface of the holder member 1022 by means of the positioning pins 1074*a* and 74*b* formed in the holder member 1022 and the round hole 1078*b* and the elongated hole 1080*b* formed in the circuit substrate 1036. Further, the light emitting module 1034 is positioned (fixed) in a direction (longitudinal direction of the vehicle) perpendicular to the surface of the holder member 1022 such that the light emitting module 1034 is sandwiched between the optical system holder member 1082 and the holder member 1022 and clamped together in that state by the tapping screws 1094.

This ensures that, so long as the round hole 1078*b* and the elongated hole 1080*b* are formed with precision, high precision in the dimension of the outer circumference of the circuit substrate 1036 of the light emitting module 1034 is not required. Therefore, the cost is prevented from increasing because formation of the round hole 1078*b* and the elongated hole 1080*b* does not accompany a considerable increase in the cost even if the size of the substrate is increased.

Further, since the light emitting module 1034 is fixed to the holder member 1022 by using the optical system holder member 1082 itself and without using a special fixing member, the number of components is reduced. Further, as compared with a case of directly fixing the light emitting module 1034 to the holder member 1022 by using a special fixing member (e.g., screw), there is no need for an area for screwing to the circuit substrate 1036 so that the size of the circuit substrate 1036 can be reduced.

Since the tapping screws 1094 are caused to abut the screw bosses 1072*a* and 72*b*, the impact from a loose screw due to creep is reduced and the long lasting reliability of the positioning precision is ensured.

Further, since the optical system holder member 1082 is configured such that a predetermined grounded part thereof comes into contact with the reference surface of the circuit substrate 1036 of the light emitting module 1034, the optical system holder member 1082 and the light emitting module 1034 are positioned with respect to each other directly. As a result, the precision of positioning the optical system holder member 1082 and the semiconductor light emitting devices 1038 of the light emitting module 1034 is improved.

Next, cords are attached to the power feeding connectors 1040*a* and 1040*b*. Subsequently, the lens holder 1062 to which the projection lens 1064 is fixed is fixed to the holder member 1022. The base part 1026 is formed with three screw bosses 1096 and three positioning pins 1098. Each of the positioning pins 1098 is formed in the vicinity of the associated screw boss 1096.

The three fixing parts 1062*c* of the lens holder 1062 are each formed with a hole 1062*d* of a size that allows the threaded part of a tapping screw 1100 to pass and a round hole 1062*e* in which the positioning pin 1098 of the holder member 1022 is fitted. Six convex parts 1062*f* are formed around the front side of the hole 1062*d* at substantially equal intervals.

Next, three tapping screws 1100 are guided through the holes 1062*d* formed in the respective fixing parts 1062*c* and assembled to the three screw bosses 1096 of the holder member 1022. In this process, the positioning pins 1098 are fitted in the respective round holes 1062*e* of the fixing parts 1062*c*. This positions and fixes the lens holder 1062 with respect to the holder member 1022.

The tapping screws 1100 are screwed into the screw bosses 1096 such that flanges thereof crush the convex parts 1062*f* formed around the front side of the holes 1064*d*. In other words, the convex parts 1062*f* function as margin for crushing. According to the method described above, the lamp unit 1020 is assembled.

The lamp unit 1020 provided in the vehicle lamp 1010 as described above provides the same benefit and advantage as the lamp unit according to the fifth embodiment or the sixth embodiment.

The embodiments of the present invention are not limited to those described above and appropriate combinations or replacements of the features of the embodiments are also encompassed by the present invention. The embodiments may be modified by way of combinations, rearranging of the processing sequence, design changes, etc., based on the knowledge of a skilled person, and such modifications are also within the scope of the present invention.

In the embodiments described above, the number of rows in the LED array is two. Alternatively, three or more rows may be provided.

In the vehicle lamp 10 according to the third embodiment, the power feeding connectors 40*a* and 40*b* are provided in the upper part 36*a* of the circuit substrate 36 and the semiconductor light emitting devices 38 are provided in the lower part 36*b*, as shown in FIG. 13. In this case, the connection terminals of the power feeding connectors 40*a* and 40*b* face upward so that there is room for improvement in terms of watertightness.

Figure 41:
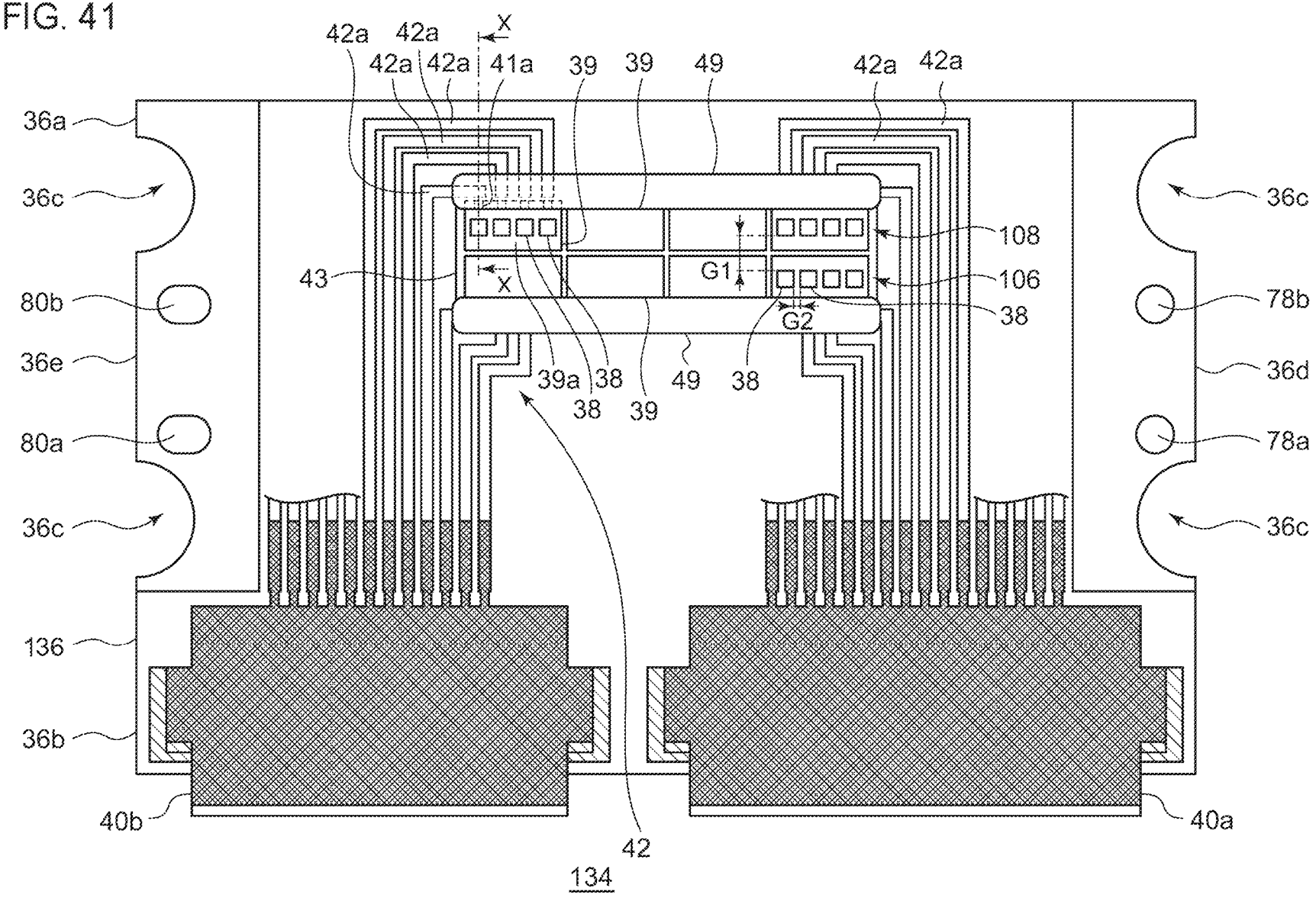
FIG. 41 is a front view of a light emitting module according to a variation of the third embodiment.

FIG. 41 is a front view of a light emitting module according to a variation of the third embodiment. In the light emitting module 134 shown in FIG. 41, the power feeding connectors 40*a* and 40*b* are provided in the lower part 36*b* of the circuit substrate 136 and the semiconductor light emitting devices 38 are provided in the upper part 36*a*. This causes the connection terminals of the power feeding connectors 40*a* and 40*b* to face downward so that water is inhibited from entering inside the power feeding connectors 40*a* and 40*b* via the connection terminals.

The invention claimed is:

1. A vehicle headlamp comprising:

a first light emitting unit in which a plurality of light emitting devices are arranged horizontally in a first row;

a second light emitting unit in which a plurality of light emitting devices are arranged horizontally in a second row;

a first reflector provided between the first light emitting unit and the second light emitting unit;

a lens that projects images of the first light emitting unit and the second light emitting unit to a space in front of a vehicle; and a planar substrate on which both the first light emitting unit and the second light emitting unit are mounted, wherein the plurality of light emitting devices are provided such that a light emitting surface of each light emitting device faces the lens, the first reflector includes reflecting surfaces that respectively reflect a portion of light emitted from the first light emitting unit in the first row and the second light emitting unit in the second row toward the lens, wherein the reflective surfaces each have a planar shape, and the first light emitting unit and the second light emitting unit are configured such that a gap G1 between the light first emitting unit and the second light emitting unit is larger than a minimum gap G2 between horizontally adjacent light emitting devices in the first light emitting unit or between horizontally adjacent light emitting devices in the second light emitting unit.

2. The lamp unit according to claim 1, wherein a number N1 of light emitting devices in the first light emitting unit is larger than a number N2 of light emitting devices in the second light emitting unit, and the first light emitting unit is provided above the second light emitting unit.

3. The lamp unit according to claim 1, wherein in the first light emitting unit, a gap G4 between adjacent light emitting devices at horizontal ends is larger than a gap G3 between adjacent light emitting devices in a center.

4. The lamp unit according to claim 1, further comprising:

a second reflector provided in an area adjacent to the second light emitting unit opposite to a side adjacent to the first light emitting unit, wherein the second reflector includes a reflecting surface that reflects a portion of light emitted from the second light emitting unit toward the lens, and the first reflector is located at a position that blocks a light path of light emitted from the first light emitting unit and traveling toward the reflecting surface of the second reflector.

* * * * *